US012479025B2

(12) United States Patent
Price et al.

(10) Patent No.: US 12,479,025 B2
(45) Date of Patent: Nov. 25, 2025

(54) POWDER HOT ISOSTATIC PRESSING CYCLE

(71) Applicant: BAE Systems plc, London (GB)

(72) Inventors: Howard James Price, Balderstone (GB); Peter Neil Stewart, Balderstone (GB); Sean Gallagher, Balderstone (GB)

(73) Assignee: BAE Systems plc, London (GB)

( * ) Notice: Subject to any disclaimer, the term of this patent is extended or adjusted under 35 U.S.C. 154(b) by 385 days.

(21) Appl. No.: 18/028,034

(22) PCT Filed: Sep. 21, 2021

(86) PCT No.: PCT/GB2021/052442

§ 371 (c)(1),
(2) Date: Mar. 23, 2023

(87) PCT Pub. No.: WO2022/064181

PCT Pub. Date: Mar. 31, 2022

(65) Prior Publication Data

US 2023/0339021 A1 Oct. 26, 2023

(30) Foreign Application Priority Data

Sep. 24, 2020 (EP) ..... 20275147
Sep. 24, 2020 (GB) ..... 2015099

(51) Int. Cl.
*B22F 3/16* (2006.01)
*B22F 3/04* (2006.01)
*B22F 3/15* (2006.01)

(52) U.S. Cl.
CPC ..... *B22F 3/16* (2013.01); *B22F 3/04* (2013.01); *B22F 3/15* (2013.01);
(Continued)

(58) Field of Classification Search
CPC ... C22C 1/04; C22C 1/0458; B22F 2301/205; B22F 3/04; B22F 3/045; B22F 3/12;
(Continued)

(56) References Cited

U.S. PATENT DOCUMENTS 4,482,398 A 11/1984 Eylon
4,861,546 A 8/1989 Friedman
(Continued)

FOREIGN PATENT DOCUMENTS

CN 109530695 A 3/2019
EP 3160670 A1 5/2017
(Continued)

OTHER PUBLICATIONS

International Search Report and Written Opinion for Appl. No. PCT/GB2021/052442 mail date Nov. 11, 2021, 15 pages.
(Continued)

*Primary Examiner* — Anessa T. Luk
(74) *Attorney, Agent, or Firm* — Maine Cernota & Curran

(57) ABSTRACT

A method of fabricating, at least in part, an article from a precursor thereof, the method comprising: providing the precursor, wherein the precursor comprises a metal having a closed pore therein; and hot isostatic pressing, HIPing, the precursor at an Nth temperature of a set of temperatures, at an Nth pressure of a set of pressures and for an Nth duration of a set of durations, thereby fabricating, at least in part, the article; wherein HIPing the precursor comprises regulating the set of temperatures, the set of pressures and/or the set of durations to control, at least in part, a morphology of the closed pore.

15 Claims, 8 Drawing Sheets

(52) U.S. Cl.
CPC ..... *B22F 2301/205* (2013.01); *B22F 2304/10* (2013.01); *B22F 2998/10* (2013.01)

(58) Field of Classification Search
CPC .... B22F 3/14; B22F 3/15; B22F 3/156; B22F 3/16; B22F 3/162; B22F 3/164; B22F 3/168; B22F 2003/145; B22F 2003/153; B22F 2003/166
See application file for complete search history.

(56) References Cited

U.S. PATENT DOCUMENTS

| | | | | |
|---|---|---|---|---|
| 2006/0157543 | A1* | 7/2006 | Abkowitz ..... | A61L 27/06 228/233.2 |
| 2013/0071283 | A1 | 3/2013 | Kano | |
| 2013/0071284 | A1 | 3/2013 | Kano | |
| 2020/0078860 | A1 | 3/2020 | Wright | |

FOREIGN PATENT DOCUMENTS

| | | | |
|---|---|---|---|
| EP | 3670031 | A1 | 6/2020 |
| JP | 57056152 | A | 4/1982 |
| JP | 2013112862 | A | 6/2013 |
| JP | 2020524217 | A | 8/2020 |
| WO | 2020030906 | A1 | 2/2020 |

OTHER PUBLICATIONS

Search Report for GB Application No. GB2015099.1 mail date Feb. 2, 2021, 3 pages.

L. Zhong Liang, Journal of Mechanical Science and Technology, vol. 23, 2009, L Zhong Liang, "Characteristics of Complicated AISI316L Automobile Components Manufactured by Powder/Metallurgy", pp. 1924-1931.

Search Report for GB Application No. GB2113417.6 mail date Dec. 15, 2021, 8 pages.

W Garcia, May 2015, "Characteristics and Applications of Ti-alloy Powders Produced via electrode Induction-Melting Gas Atomization", Titanium Europe 2015, [online], Available from: https://cdn.ymaws.com/titanium.org/resource/resmgr/2013_2017_eur_papers/GarciaWilfredoTiEu2015AdvPow.pdf.

Search Report for EP Application No. 20275147.5 mail date Feb. 4, 2021, 11 pages.

* cited by examiner

POWDER HOT ISOSTATIC PRESSING CYCLE

RELATED APPLICATIONS

This application is a national phase application filed under 35 USC § 371 of PCT Application No. PCT/GB2021/052442 with an International filing date of Sep. 21, 2021, which claims priority of GB Patent Application 2015099.1, filed Sep. 24, 2020, and EP patent application No. 20275147.5, filed Sep. 24, 2020. Each of these applications is herein incorporated by reference in its entirety for all purposes.

FIELD OF THE INVENTION

The present invention relates to hot isostatic pressing.

BACKGROUND

Powder metallurgy (PM), including powder forging, hot isostatic pressing (HIP), metal injection moulding (MIM), electric current assisted sintering (ECAS) and additive manufacturing (AM), provides near net shape (NNS) fabrication of articles from metal powders, preferably spherical metal powders. Spherical metal powders are typically produced by plasma spheroidisation or atomisation, including gas atomisation (GA), plasma spherodisation (PS), plasma atomisation (PA) and plasma rotating electrode process (PREP). GA and PA typically produce relatively finer powders compared with PREP and hence preferred for some PM techniques. Contaminant levels in GA powder may be relatively lower than PA powder and hence preferred for some metals. However, GA may result in entrapment of gas as pores in the GA powder. These gas pores are detrimental to the mechanical properties, particularly fatigue properties, of the PM fabricated articles and cannot be entirely eliminated, even using HIPing.

Hence, there is a need to improve PM.

SUMMARY OF THE INVENTION

It is one aim of the present invention, amongst others, to provide an apparatus for, and a method of, HIPing which at least partially obviates or mitigates at least some of the disadvantages of the prior art, whether identified herein or elsewhere. For instance, it is an aim of embodiments of the invention to provide a method of HIPing that attenuates the effects of entrapped gas pores on the mechanical properties of PM fabricated articles. For instance, it is an aim of embodiments of the invention to provide an apparatus for fabricating, at least in part, an article using HIPping that improves control of the mechanical properties thereof. For instance, it is an aim of embodiments of the invention to provide an article, fabricated at least in part using HIPing, having improved mechanical properties, compared with an article fabricated at least in part using conventional HIPing.

A first aspect provides a method of fabricating, at least in part, an article from a precursor thereof, the method comprising:

- providing the precursor, wherein the precursor comprises a metal having a closed pore therein;
- isostatically compressing the precursor, thereby providing a compressed precursor; and
- hot isostatic pressing, HIPing, the compressed precursor at an Nth temperature of a set of temperatures, at an Nth pressure of a set of pressures and for an Nth duration of a set of durations, thereby fabricating, at least in part, the article.

A second aspect provides a hot isostatic press, HIP, apparatus for fabricating, at least in part, an article from a precursor thereof, wherein the apparatus is configured to:

- HIP the precursor, comprising a metal having a closed pore therein, at an Nth temperature of a set of temperatures, at an Nth pressure of a set of pressures and for an Nth duration of a set of durations, thereby fabricating, at least in part, the article, by regulating the set of temperatures, the set of pressures and/or the set of durations to control, at least in part, a morphology of the closed pore.

A third aspect provides an article formed according to the method of the first aspect and/or the apparatus of the second aspect.

A fourth aspect provides a computer comprising a processor and a memory configured to implement, at least in part, a method according to the first aspect.

A fifth aspect provides a computer program comprising instructions which, when executed by a computer comprising a processor and a memory, cause the computer to perform a method, at least in part, according to the first aspect.

A sixth aspect provides a non-transient computer-readable storage medium comprising instructions which, when executed by a computer comprising a processor and a memory, cause the computer to perform a method, at least in part, according to the first aspect.

A seventh aspect provides a method of fabricating, at least in part, an article from a precursor thereof, the method comprising: providing the precursor, wherein the precursor comprises a metal having a closed pore therein; and hot isostatic pressing, HIPing, the precursor at an Nth temperature of a set of temperatures, at an Nth pressure of a set of pressures and for an Nth duration of a set of durations, thereby fabricating, at least in part, the article; wherein HIPing the precursor comprises regulating the set of temperatures, the set of pressures and/or the set of durations to control, at least in part, a morphology of the closed pore.

DETAILED DESCRIPTION OF INVENTION

According to the present invention there is provided a method, as set forth in the appended claims. Also provided is an apparatus and an article. Other features of the invention will be apparent from the dependent claims, and the description that follows.

Method

The first aspect provides a method of fabricating, at least in part, an article from a precursor thereof, the method comprising:

- providing the precursor, wherein the precursor comprises a metal having a closed pore therein;
- isostatically compressing the precursor, thereby providing a compressed precursor; and
- hot isostatic pressing, HIPing, the compressed precursor at an Nth temperature of a set of temperatures, at an Nth pressure of a set of pressures and for an Nth duration of a set of durations, thereby fabricating, at least in part, the article.

In one preferred example, the first aspect provides a method of fabricating an article from a precursor thereof, the method comprising:

providing the precursor, comprising encapsulating a powder of an α+β Ti alloy in a container, wherein the powder is formed by electrode induction gas atomisation, EIGA;

cold pressurisation of the precursor by isostatically compressing the precursor at a first pressure, thereby providing a compressed precursor; and hot isostatic pressing, HIPing, the compressed precursor at an Nth pressure in a range from 75 MPa to 150 MPa and at an Nth temperature in a range from 850° C. to 950° C., thereby fabricating the article;

wherein a ratio of the first pressure to the Nth pressure is in a range from 1:2 to 9:10.

In this way, by isostatically compressing the precursor before or as part of the HIPing of the precursor, the morphology (i.e. shape) of the closed pore in the metal is controlled during HIPing, thereby defining the morphology of the residual closed pore in the article. Particularly, by controlling the morphology of the closed pore in this way, the residual closed pore in the article may be relatively more spherical, thereby lessening deleterious effects due there to. Notably, relatively more spherical, ideally spherical, closed pores result in relatively lower stress concentrations compared with ellipsoidal or toroidal closed pores, for example. In this way, the effect of the closed pore on the mechanical properties, for example the detrimental effect on fatigue properties, of the fabricated article is attenuated compared with an article fabricated at least in part using conventional HIPing.

In other words, the method comprises modifying the HIP cycle, for example when using titanium alloy powder to manufacture aircraft components (i.e. articles). The method is particularly beneficial when using powder produced by GA that may result in argon gas entrapment, such as by EIGA, but which may be preferred over using powder produced by PA, due to reduced contamination. Notably, argon is virtually insoluble in titanium and thus remains as an entrapped gas, even after HIPing. The method is also suitable for PM articles fabricated using any powder susceptible to gas entrapment even when the PM involves a melting process such as Electron Beam Powder Bed Selective Melting or Laser Powder Bed Selective Melting, since the gas may remain entrapped in pores therein.

It should be understood that temperatures, pressures and times defined herein are in SI units, unless noted otherwise. It should be understood that generally, temperature changes applied to the precursor during the HIPing require equilibration through the precursor, a duration of which depends, at least in part, on the rate of temperature change, the magnitude of the temperature change, a thermal mass of the precursor, a thermal conductivity of the precursor and/or a dimension of the precursor. It should be understood that the pressures are those applied to the precursor during the HIPing c.f. pressure in the closed pore. In contrast to temperature changes, pressure changes are experienced immediately by the entire precursor.

The modifications to the HIP cycle are intended to control the way in which entrapped bubbles (i.e. closed pores), such as of argon, within powder granules (i.e. particles) compress and the subsequent shape that these bubbles will develop. It is also intended to avoid damage being caused by a subsequent high temperature heat treatment cycle (e.g. annealing or stress relieving) or exposure to high temperatures during service.

Fabricating

The method is of fabricating, at least in part, the article from the precursor thereof. That is, fabricating (i.e. manufacturing, forming) of the article from the precursor thereof includes the HIPing, as described herein. It should be understood that fabricating the article may include other steps, before and/or after the HIPing. For example, fabricating the article may include additive manufacturing, thereby providing the precursor, before the HIPing. For example, fabricating the article may include heat treating, thermomechanical forming and/or machining (i.e. subtractive manufacturing) the article after the HIPing Article The method is of fabricating, at least in part, the article from the precursor thereof.

In one example, the article comprises and/or is an aerospace component, such as an airframe component, a vehicle component, such as an engine component, or a medical component, such as an implantable medical device.

Precursor

The method is of fabricating, at least in part, the article from the precursor thereof. It should be understood that the precursor is of the article, for example powder, encapsulated powder, a casting, a sintered part or a part manufactured by additive manufacturing, AM.

The method comprises providing the precursor, wherein the precursor comprises the metal having the closed pore therein. That is, the precursor has the closed pore therein in the metal thereof. For example, the closed pore maybe in a powder particle, a casting, a sintered part or a part manufactured by AM.

In one example, providing the precursor comprises additive manufacturing, for example selective laser melting a powder comprising a set of particles including a first particle. In one example, providing the precursor comprises additive manufacturing, AM, the precursor from feed material, for example wherein the powder comprises the metal having the closed pore therein and/or wherein the closed pore is formed during the AM. That is, the precursor is provided by AM and subsequently, HIPed as described herein, for example so as to reduce porosity and/or increase a density thereof.

In one example, the precursor comprises a powder comprising a set of particles including a first particle and wherein the first particle comprises the closed pore. In one example, providing the precursor comprises encapsulating a powder of the metal having the closed pore therein, for example in a container. Typically, the container is removed by machining after the HIPing.

Additive Manufacturing

ISO/ASTM 52900-15 defines seven categories of additive manufacturing processes, including binder jetting, directed energy deposition (DED), material extrusion, material jetting, powder bed fusion (PBF), sheet lamination, and vat photopolymerization. These additive manufacturing processes are known.

Particularly, DED and PBF techniques, such as direct metal laser sintering (DLMS), selective heat sintering (SHS), selective laser sintering (SLS), selective laser melting (SLM), laser metal deposition (LMD) and electron beam melting (EBM), are suitable for creating (i.e. manufacturing, forming) for example, metal articles, from feed materials such as metal powders and/or wires (also known as filaments). Similarly, polymeric articles may be manufactured from feed materials such as powders and/or filaments comprising polymeric compositions, for example including thermoplastics. The feed materials are heated to elevated temperatures, including melting thereof, for example at a temperature T in a range of about $$\frac{2}{3}T_m \leq T \leq T_m,$$

where $T_m$ is the absolute melting temperature (K) of the feed material.

In one example, the AM comprises and/or is DED, for example wire or powder DED, and/or PBF, for example DMLS, SHS, SLS, SLM, LMD or EBM.

Metal

In one example, the metal is a transition metal, for example a first row, a second row or a third row transition metal. In one example, the metal is Sc, Ti, V, Cr, Mn, Fe, Co, Ni, Cu or Zn. In one example, the metal is Y, Zr, Nb, Mo, Tc, Ru, Rh, Pd, Ag or Cd. In one example, the metal is Hf, Ta, W, Re, Os, Ir, Pt, Au or Hg.

It should be understood that unalloyed metals refer to metals having relatively high purities, for example at least 95 wt. %, at least 97 wt. %, at least 99 wt. %, at least 99.5 wt. %, at least 99.9 wt. %, at least 99.95 wt. %, at least 99.99 wt. %, at least 99.995 wt. % or at least 99.999 wt. % purity.

In one example, the metal comprises a ferrous alloy or a nonferrous alloy, for example a stainless steel, an Al alloy, a copper alloy, a Ti alloy, a Ni alloy or mixtures of respective alloys thereof, preferably corresponding and/or compatible alloys (for example having similar or the same nominal compositions) thereof.

In one example, the metal comprises a first row transition metal for example Sc, Ti, Cr, Mn, Ni or Cu, a second row transition metal for example Zr or Nb, a group III element for example Al, and/or a mixture thereof, for example an alloy.

In one preferred example, the metal comprises and/or consists of a Ti alloy, for example a Ti-6Al-4V alloy, as described below, according to AMS 4911R, AMS 4928W, AMS 4965K and AMS 4905F.

Ti Alloy

In one example, the metal comprises and/or is a Ti alloy powder, for example an α+β Ti alloy, or an α+β Ti alloy heat treated above a beta transus temperature $\beta_{transus}$ of the α+β Ti alloy.

α+β Ti Alloys

Elements having an atomic radius within ±15% of the atomic radius of Ti are substitutional elements and have significant solubility in Ti. Elements having an atomic radius less than 59% of the atomic radius of Ti, for example H, N, O and C, occupy interstitial sites and also have substantial solubility. The relatively high solubilities of substitutional and interstitial elements in Ti makes it difficult to design precipitation-hardened Ti alloys. However, B has a similar but larger radius than C, O, N and H and it is therefore possible to induce Ti boride precipitation. Cu precipitation is also possible in some alloys.

The substitutional elements may be categorised according to their effects on the stabilities of the α and β phases. Hence, Al, O, N and Ga are a stabilisers while Mo, V, W and Ta are all β stabilisers. Cu, Mn, Fe, Ni, Co and H are also B stabilisers but form the eutectoid. The eutectoid reaction is frequently sluggish (since substitutional atoms involved) and is suppressed. Mo and V have the largest influence on β stability and are common alloying elements. W is rarely added due to its high density. Cu forms $TiCu_2$, which makes such Ti alloys age-hardening and heat treatable. Zr, Sn and Si are neutral elements.

The interstitial elements do not fit properly in the Ti lattices and cause changes in the lattice parameters. Hydrogen is the most important interstitial element. Body-centred cubic (BCC) Ti has three octahedral interstices per atom while closed-packed hexagonal (CPH) Ti has one octahedral interstice per atom. The latter are therefore larger, so that the solubility of O, N, and C is much higher in the α phase.

Most α+β Ti alloys (also known as α–β Ti alloys, alpha-beta Ti alloys, dual-phase Ti alloys or two-phase Ti alloys) have high-strength and formability, and contain 4-6 wt. % of β stabilisers which allow substantial amounts of β to be retained on quenching from the β→α+β phase fields. A typical α+β Ti alloy is Ti-6Al-4V (all nominal compositions in wt. % unless noted otherwise), while other α+β Ti alloys include Ti-6Al-6V-2Sn and Ti-6Al-2Sn-4Zr-Mo. Al reduces alloy density, stabilises and strengthens the α phase and increases the α+β→β transformation temperature while V provides a greater amount of the more ductile β phase for hot-working and reduces the α+β→β transformation temperature. Table 1 shows nominal compositions of selected α+β Ti alloys.

Nominal compositions of selected α + β Ti alloys.

| α + β Ti alloys | Tensile strength (MPa, | 0.2% yield strength (MPa, | Composition (wt. %) | | | | | | | | | Impurity limits (wt. %, max) | | | | |
|---|---|---|---|---|---|---|---|---|---|---|---|---|---|---|---|---|
| designation | min) | min) | Al | Sn | Zr | Mo | V | Cu | Mn | Cr | Si | N | C | H | Fe | O |
| Ti-6Al-4V (g) (i) AMS 4911R | 900 | 830 | 5.5-6.75 | | | | 3.5-4.5 | | | | | 0.05 | 0.08 | 0.015 | 0.30 | 0.20 |
| Ti-6Al-4V (a) (g) (i) AMS 4928W | 900 | 830 | 5.5-6.75 | | | | 3.5-4.5 | | | | | 0.05 | 0.08 | 0.0125 | 0.30 | 0.20 |
| Ti-6Al-4V ELI (g) (h) AMS 4930K | 830 | 760 | 5.5-6.5 | | | | 3.5-4.5 | | | | | 0.05 | 0.08 | 0.0125 | 0.25 | 0.13 |
| Ti-6Al-4V (g) (i) AMS 4965K | 890 | 820 | 5.5-6.75 | | | | 3.5-4.5 | | | | | 0.05 | 0.08 | 0.0125 | 0.30 | 0.20 |
| Ti-6Al-4V (a) (g) (i) AMS 4967M | 890 | 820 | 5.5-6.75 | | | | 3.5-4.5 | | | | | 0.05 | 0.08 | 0.0125 | 0.30 | 0.20 |
| Ti-6Al-4V ELI (g) (h) (j) AMS 6932C | 860 | 790 | 5.5-6.5 | | | | 3.5-4.5 | | | | | 0.05 | 0.08 | 0.0125 | 0.25 | 0.13 |
| Ti-6Al-4V (g) (h) (i) AMS 4905F | 860 | 790 | 5.6-6.3 | | | | 3.6-4.4 | | | | | 0.03 | 0.05 | 0.0125 | 0.25 | 0.12 |
| Ti-6Al-6V-2Sn (a) (g) (i) AMS 4971L | 1030 | 970 | 5.0-6.0 | 1.5-2.5 | | | 5.0-6.0 | 0.35-1.0 | | | | 0.04 | 0.05 | 0.015 | | 0.2 |

-continued

Nominal compositions of selected α + β Ti alloys.

| α + β Ti alloys designation | Tensile strength (MPa, min) | 0.2% yield strength (MPa, min) | Composition (wt. %) Al | Sn | Zr | Mo | V | Cu | Mn | Cr | Si | Impurity limits (wt. %, max) N | C | H | Fe | O |
|---|---|---|---|---|---|---|---|---|---|---|---|---|---|---|---|---|
| Ti-6Al-4V (g) (h) TIMETAL 6-4 ASTM Grade 5 Mil T-9047 | 970 | 920 | 5.5-6.75 | | | | 3.5-4.5 | | | | | 0.05 | 0.08 | 0.015 | 0.40 | 0.2 |
| Ti-6Al-4V (g) (h) TIMETAL 6-4 ELI ASTM Grade 23 AMS 4981 | 970 | 920 | 5.5-6.5 | | | | 3.5-4.5 | | | | | 0.03 | 0.08 | 0.0125 | 0.25 | 0.13 |
| Ti-6Al-4V-0.1Ru (g) (h) (k) ASTM Grade 29 | 970 | 920 | 5.5-6.5 | | | | 3.5-4.5 | | | | | 0.03 | 0.08 | 0.015 | 0.25 | 0.13 |
| Ti-8Mn (a) | 860 | 760 | | | | | | | 8 | | | 0.05 | 0.08 | 0.015 | 0.5 | 0.2 |
| Ti-7Al-4Mo (a) | 1030 | 970 | 7 | | | 4 | | | | | | 0.05 | 0.1 | 0.013 | 0.3 | 0.2 |
| Ti-6Al-2Sn-4Zr-6Mo (b) AMS 4981 | 1170 | 1100 | 6 | 2 | 4 | 6 | | | | | | 0.04 | 0.04 | 0.0125 | 0.15 | 0.15 |
| Ti-5Al-2Sn-2Zr-4Mo-4Cr (b)(c) | 1125 | 1055 | 5 | 2 | 2 | 4 | | | | 4 | | 0.04 | 0.05 | 0.0125 | 0.3 | 0.13 |
| Ti-6Al-2Sn-2Zr-2Mo-2Cr (c) | 1030 | 970 | 5.7 | 2 | 2 | 2 | | | | 2 | 0.25 | 0.03 | 0.05 | 0.0125 | 0.25 | 0.14 |
| Ti-3Al-2.5V (d) | 620 | 520 | 3 | | | | 2.5 | | | | | 0.015 | 0.05 | 0.015 | 0.3 | 0.12 |
| Ti-4Al-4Mo-2Sn-0.5Si | 1100 | 960 | 4 | 2 | | 4 | | | | | 0.5 | (e) | 0.02 | 0.0125 | 0.2 | (e) |

(a) Mechanical properties given for the annealed condition; may be solution treated and aged to increase strength;
(b) Mechanical properties given for the solution-treated-and-aged condition; alloy not normally applied in annealed condition;
(c) Semi-commercial alloy; mechanical properties and composition limits subject to negotiation with suppliers;
(d) Primarily a tubing alloy; may be cold drawn to increase strength;
(e) Combined $O_2 + 2N_2 = 0.27\%$;
(f) Also solution treated and aged using an alternative aging temperature (480° C., or 900° F.);
(g) other elements total (wt. %, max) 0.40;
(h) other elements each (wt. %, max) 0.10;
(i) Y (wt. %, max) 0.005;
(j) Y (wt. %, max) 0.05;
(k) Ru (wt. %, min) 0.08, Ru (wt. %, max) 0.14

Table 1: Nominal compositions of selected α+β Ti alloys. (a) Mechanical properties given for the annealed condition; may be solution treated and aged to increase strength; (b) Mechanical properties given for the solution-treated-and-aged condition; alloy not normally applied in annealed condition; (c) Semi-commercial alloy; mechanical properties and composition limits subject to negotiation with suppliers; (d) Primarily a tubing alloy; may be cold drawn to increase strength; (e) Combined $O_2+2N_2=0.27\%$; (f) Also solution treated and aged using an alternative aging temperature (480° C., or 900° F.); (g) other elements total (wt. %, max) 0.40; (h) other elements each (wt. %, max) 0.10; (i) Y (wt. %, max) 0.005; (j) Y (wt. %, max) 0.05; (k) Ru (wt. %, min) 0.08, Ru (wt. %, max) 0.14

Ti-6Al-4V (martensitic α+β Ti alloy; $K_\beta=0.3$) accounts for about half of all the Ti alloys produced and is popular because of its strength (1100 MPa), creep resistance at 300° C., fatigue resistance, good castability, plastic workability, heat treatability and weldability. Depending on required mechanical properties, heat treatments applied to Ti-6Al-4V alloys and more generally to α+β Ti alloys include: partial annealing (600-650° C. for about 1 hour), full annealing (700-850° C. followed by furnace cooling to about 600° C. followed by air cooling) or solutioning (880-950° C. followed by water quenching) and ageing (400-600° C.).

α+β Ti alloys constitute a very important group of structural materials used in aerospace applications. The microstructures of these α+β Ti alloys can be varied significantly during thermomechanical processing and/or heat treatment, allowing for tailoring of their mechanical properties, including fatigue behaviour, to specific application requirements.

The main types of microstructure of α+β Ti alloys are:

1. lamellar, formed after slow cooling when deformation or heat treatment takes place at a temperature in the single-phase β field above the beta transus temperature $\beta_{transus}$, comprising colonies of HCP α phase lamellae within large BCC β phase grains of several hundred microns in diameter; and
2. equiaxed, formed after deformation in the two-phase α+β field (i.e. below the beta transus temperature $\beta_{transus}$), comprising globular a-phase dispersed in a β phase matrix.

In one example, the Mth temperature of the set of temperatures is below a beta transus temperature $\beta_{transus}$ of the α+β Ti alloy.

The beta transus temperature $\beta_{transus}$ is the temperature at which the α+β→β transformation takes place and is thus the lowest temperature at which the Ti alloy is composed of a volume fraction $V_f=1$ of the BCC β phase.

The lamellar microstructure is characterized by relatively low tensile ductility, moderate fatigue properties, and good creep and crack growth resistance. Important parameters of the lamellar microstructure with respect to mechanical properties include the β grain size D, size d of the colonies of a phase lamellae, thickness t of the α phase lamellae and the morphology of the interlamellar interface (β phase). Generally, an increase in cooling rate leads to refinement of the microstructure-both α phase colony size d and α phase lamellae thickness t are reduced. Additionally, new α phase colonies tend to nucleate not only on β phase boundaries but also on boundaries of other α phase colonies, growing perpendicularly to the existing α phase lamellae. This leads to formation of a characteristic microstructure called "basket weave" or Widmanstätten microstructure.

The equiaxed microstructure has a better balance of strength and ductility at room temperature and fatigue properties which depend noticeably on the crystallographic texture of the HCP α phase.

An advantageous balance of properties can be obtained by development of bimodal microstructure consisting of primary a grains and fine lamellar a colonies within relatively small β grains (10-20 μm in diameter).

The phase composition of α+β Ti alloys after cooling from the β phase is controlled, at least in part, by the cooling rate. The kinetics of phase transformations is related, at least in part, to the β phase stability coefficient $K_\beta$ due to the chemical composition of the α+β Ti alloy. The range of the α+β→B phase transformation temperature determines, at least in part, conditions of thermomechanical al processing intended for development of a desired microstructure. Start and finish temperatures of α+β→β phase transformation vary depending, at least in part, on the amounts of β stabilizing elements (Table 2).

| Temperature (° C.) | Ti—6Al—4V | Ti—6Al—2Mo—2Cr | Ti—6Al—5Mo—5V—1Cr—1Fe |
|---|---|---|---|
| $T_{\alpha+\beta\rightarrow\beta}^{ns}$ | 890 | 840 | 790 |
| $T_{\alpha+\beta\rightarrow\beta}^{ps}$ | 930 | 920 | 830 |
| $T_{\alpha+\beta\rightarrow\beta}^{f}$ | 985 | 980 | 880 |
| $T_{\beta\rightarrow\alpha+\beta}^{s}$ | 950 | 940 | 850 |
| $T_{\beta\rightarrow\alpha+\beta}^{s}$ | 870 | 850 | 810 |

Table 2: Start and finish temperature of the α+β→β phase transformation for selected α+β Ti alloys ($v_h=v_c=0.08°$ C. $s^{-1}$); ns: nucleation start; ps: precipitation start; s: start; f: finish.

The microstructure of α+β Ti alloys after deformation or heat treatment carried out above the beta transus temperature $\beta_{transus}$ depends, at least in part, on the cooling rate. Relatively higher cooling rates (>18° C. $s^{-1}$) result in martensitic α' (α") microstructure for alloys having β phase stability coefficient $K_\beta<1$ and metastable $\beta_M$ microstructure for alloys having higher β phase stability coefficient $K_\beta$. Low and moderate cooling rates lead to development of lamellar microstructures consisting of colonies of α phase lamellae within large β phase grains. A decrease in cooling rate cause an increase in both the thickness t of individual α phase lamellae and size d of the α colonies. These in turn lower the yield stress and tensile strength of these α+β Ti alloys.

The lamellar α phase microstructure of α+β Ti alloys heat treated in the β phase has a beneficial effect on fatigue behaviour, due to frequent changes in crack direction and secondary crack branching. When α phase lamellae are too large, thin layers of β phase are not capable of absorbing large amounts of energy and retard crack propagation. In this case, the α phase colonies behave as singular element of the microstructure. This phenomenon is more pronounced in α+β Ti alloys having smaller β phase stability coefficients $K_\beta$, such as Ti-6Al-4V. A sufficient thickness of the β phase enables absorption of energy in the process of plastic deformation of regions ahead of crack tips, contributing to slowing a rate of crack propagation and therefore increasing fatigue life.

In one example, the metal comprises and/or is a Ti alloy selected from: Tekna Ti64 (RTM) available to ASTM Grade 5 and Grade 23 as −25/5, −45/15, −53/20, −105/45 and −250/90 particle size distributions, available from Tekna Plasma Systems Inc (Canada); Carpenter CT PowderRange Ti64 S (RTM) available to ASTM Grade 5 and Grade 23, available from Carpenter Technology Corporation (USA); Osprey Ti-6Al-4V Grade 5 (RTM) and/or Osprey Ti-6Al-4V Grade 23 (RTM), available from Sandvik AB (Sweden) and produced by EIGA; CPTi-Gr. 1, Gr. 2, Ti64-Gr. 5, Gr. 23, Ti6242, Ti5553 and/or Beta 21S, available from GKN Sinter Metals Engineering GmbH (Germany). Similar Ti alloys include: LPW Ti6-4 High Performance Titanium; UNS R56400/R56407; 3D Systems Ti Gr. 23; Concept Laser CL 41 TI ELI; EOS Ti64ELI; Renishaw Ti6Al4V ELI-0406; SLM Solutions TiAl6V4; and TRUMPF TitaniumT: 64 ELI-A LMF. In one example, the metal comprises and/or is a Ni alloy selected from: Osprey Alloy 625 (RTM) and/or Osprey Alloy 718 (RTM), available from Sandvik AB (Sweden); IN625, IN718, and/or Ni—Ti, available from GKN Sinter Metals Engineering GmbH (Germany). In one example, the metal comprises and/or is an Al alloy selected from: AlSi7Mg, AlSi10Mg, and/or Al4047, available from GKN Sinter Metals Engineering GmbH (Germany). In one example, the metal comprises and/or is an Al alloy selected from: 304L, 316L, 420, and/or 17-4PH, available from GKN Sinter Metals Engineering GmbH (Germany). In one example, the metal comprises and/or is an Fe alloy selected from: 4340, 4630, 5120, 8620, 20MnCr5, 42CrMo4, 1.2709, H13, Fe—Si and/or Fe—Ni, available from GKN Sinter Metals Engineering GmbH (Germany).

In one example, the metal comprises and/or is a Ti alloy, for example an α+β Ti alloy, wherein the Nth pressure is in a range from 75 MPa to 150 MPa, preferably in a range from 90 MPa to 125 MPa and/or the Nth temperature is in a range from 850° C. to 950° C., preferably in a range from 875° C. to 925° C.

Powder

It should be understood that the powder comprises particles that are solid and may include discrete and/or agglomerated particles. In one example, the particles have a regular shape, such as a spherical shape. In one example, the particles have an irregular shape, such as a spheroidal, a flake or a granular shape.

Generally, the powder may comprise any material amenable to fusion by melting. The powder may comprise a metal, such as Al, Ti, Cr, Fe, Co, Ni, Cu, W, Ag, Au, Pt and/or an alloy thereof. Generally, the powder may comprise any metal from which particles may be produced by atomisation. These particles may be produced by atomisation, such as gas atomisation, close-coupled gas atomisation, plasma atomisation or water atomisation, or other processes known in the art. These particles may have regular, such as spherical, shapes and/or irregular, such as spheroidal, flake or granular, shapes.

These particles may have a size of at most 300 μm, at most 250 μm, at most 200 μm, at most 150 μm, at most 100 μm, at most 75 μm, at most 50 μm, at most 25 μm, at most 15 μm, at most 10 μm, at most 5 μm, or at most 1 μm. These particles may have a size of at least 150 μm, at least 100 μm, at least 75 μm, at least 50 μm, at least 25 μm, at least 15 μm, at least 10 μm, at least 5 μm, or at least 1 μm. Preferably, these particles have a size in a range 10 μm to 200 μm. More preferably, these particles have a size in a range 60 μm to 150 μm. In one example, the powder comprises particles having a size in a range from 5 μm to 200 μm, preferably from 10 μm to 150 μm. For L-PBF of Ti alloys for example, the powder preferably comprises particles having a size in a range from 15 μm (D10) to 45 μm (D90) and/or in a range from 20 μm (D10) to 63 μm (D90), while for EBM of Ti alloys, the powder preferably comprises particles having a size in a range from 45 μm (D10) to 105 μm (D90). For L-PBF of Ni, Al alloys and stainless steels for example, the powder preferably comprises particles having a size in a range from 15 μm (D10) to 53 μm (D90), while for EBM of Ni, Al alloys and stainless steels, the powder preferably comprises particles having a size in a range from 50 μm (D10) to 150 μm (D90).

For regular shapes, the size may refer to the diameter of a sphere or a rod, for example, or to the side of a cuboid. The size may also refer to the length of the rod. For irregular shapes, the size may refer to a largest dimension, for example, of the particles. The particle size distribution may be measured by use of light scattering measurement of the particles in an apparatus such as a Malvern Mastersizer 3000, arranged to measure particle sizes from 10 nm to 3500 micrometres, with the particles wet-dispersed in a suitable carrier liquid (along with a suitable dispersant compatible with the particle surface chemistry and the chemical nature of the liquid) in accordance with the equipment manufacturer's instructions and assuming that the particles are of uniform density. The particle size distribution may be measured according to ASTM B822-17 Standard Test Method for Particle Size Distribution of Metal Powders and Related Compounds by Light Scattering.

In one example, the particles have a relatively small particle size D, for example, at most 50 μm, preferably at most 20 μm. In one example, the particles have a relatively wide particle size D distribution, including a non-unimodal (e.g. bimodal) particle/or a non-monodisperse (i.e. not singular particle size) size distribution and, for example wherein D90/D10 is at least 3, preferably at least 5, more preferably at least 10). In one example, the particles have a relatively high angle of repose, for example, at least 30°, more preferably at least 40°. In one example, the particles have a relatively high powder anisotropy so that stresses in the powder are not equal in all directions and/or relatively high friction so that shear stresses in the powder may be proximal walls.

In one example, the powder comprises an additive, an alloying addition, a flux, a binder and/or a coating. In one example, the powder comprises particles having different compositions, for example a mixture of particles having different compositions.

Generally, spherical metal powders are preferred as feed materials for near net shape (NNS) fabrication via powder metallurgy (PM), including powder forging, hot isostatic pressing (HIP), metal injection moulding (MIM), electric current assisted sintering (ECAS) and additive manufacturing (AM).

For titanium alloy powders, for example, important characteristics for PM include particle size, particle size distribution, flowability and chemical composition including oxygen content. The requirements of particle size distribution (PSD) vary with applications: ≤45 μm (325 mesh) for MIM, 15 μm to 45 μm for SLM, 10 to 45 μm for cold spraying and 45 μm to 106 μm for EBM. Oxygen is a strong solution strengthener for titanium alloys, but an excess will compromise ductility and fracture toughness. To meet the oxygen requirement of industrial standards for final manufactured components, which is typically less than 0.2 wt. %, the oxygen content of titanium alloy powders should be to be ≤0.15 wt. %. Preferably, the powders have high purity, high sphericity and flowability together with no trapped gas-bubble porosity. However, generally, oxygen content of titanium alloy powders is inversely proportional to particle size. Further, most NNS methods require powder to have excellent flowability, which is affected by powder shape and size, interparticle friction, type of material and environmental factors. Generally, powders having good flowability preferably have a spherical shape and particle size should be relatively large. That is, flowability also decreases with decreasing particle size. Furthermore, powders preferably have good apparent density and tap density, which also affect the density and uniformity of manufactured parts.

Typically, spherical titanium powder is produced by plasma spheroidisation or atomisation, including gas atomisation (GA), plasma spherodisation (PS), plasma atomisation (PA) and plasma rotating electrode process (PREP). Gas atomisation includes free fall gas atomisation (FFGA), close coupled gas atomisation (CCGA) and electrode induction gas atomisation (EIGA). PREP powder is considered to have very high purity and near-perfect spherical shape. However, the particle size of PREP powder is typically relatively coarse, for example 50 μm to 350 μm, which is coarser than desired for SLM, EBM and MIM applications. Relatively finer spherical titanium alloy powder can, however, be produced via GA and PA methods. Typical particle sizes of GA and PA titanium alloy powders range from 10 μm to 300 μm.

All atomisation processes include melting, atomisation and solidification. Melting is typically by vacuum induction melting, plasma arc melting including RF plasma arc melting, induction drip melting or direct plasma heating. Atomisation breaks the liquid metal into droplets, which solidify during flight in an inert atmosphere, and is typically achieved using a high-pressure gas, usually argon, to break up a stream of the liquid metal through nozzle. The inert atmosphere is usually ultra high purity argon or helium, to reduce oxygen contamination.

EIGA generally produces ceramic free powder, in which the liquid metal is not in contact with any refectory metals or other ceramic components that may introduce contamination. Particularly, in contrast with PA, EIGA powders are free from tungsten contamination and hence may be preferred.

However, GA, typically results in formation of satellite particles, which are fine particles that fly back and collides with partially molten particles as a result of circulation of gas in the atomising chamber. The satellite particles are detrimental to free-flowing of the particles. Furthermore, GA typically results in formation of gas pores or gas bubbles in the powder as a result of the high-pressure gas used for atomisation becoming entrapped in the liquid metal. These gas pores are detrimental to the mechanical properties, particularly fatigue properties, of the PM article and cannot be entirely eliminated, even using HIPing. Furthermore, these gas pores may remain after PBF and subsequent HIPing of an article.

In more detail, the entrapment of argon in EIGA powder, for example, takes the form of singular bubbles of nominally spherical shape that form during the solidification process. In the EIGA powder production process, the argon is used to generate the particles by being blown into a gas stream of molten titanium (or titanium alloy). The bubbles tend to only occur in particles above a certain size and typically are not seen in powder particles that are less than around 50 μm in diameter. For Powder Bed Selective Laser Melting AM, EIGA powder used typically has a particle size distribution (PSD) of 15 μm to 45 μm and so avoids the problem of argon entrapment. However, this relatively narrow particle size distribution used in SLM is unsuitable for powder HIPing, where there is a need for a relatively broad particle size distribution in order to increase the "tap density" (i.e. the density of the uncompacted powder). This is necessary because powder HIP relies on filling, evacuating and sealing shaped canisters containing powder and the subsequent total compaction during HIPing to produce the desire near net shape product. If the tap density is too low, there is excessive compaction during HIPing and is more costly. However, EIGA titanium alloy powder is desirable for HIPping because tungsten contamination is avoided.

In one example, the powder is formed by gas atomisation, optionally wherein the first particle has a dimension of at least 50 μm.

Closed Pore

It should be understood that the closed pore contains an entrapped gas. For example, gas may become entrapped during production of the metal such as entrapped during GA of a powder of the metal. For example, gas may become entrapped (more commonly known as porosity) during AM of a powder or other feedstock of the metal in a protective atmosphere comprising the gas. It should be understood that the pore is closed i.e. the entrapped gas is contained in the pore. In one example, the gas is an inert gas for example a noble gas such as argon, helium or neon. In one example, the gas has a relatively low solubility in the metal. In one example, the closed pore in the metal of the precursor has a dimension, for example a diameter, in a range from 1 μm to 250 μm, preferably in a range from 10 μm to 100 μm, more preferably in a range from 25 μm to 75 μm. It should be understood that a volume of the closed pore is less than a volume of the metal having the closed pore therein. In one example, the closed pore in the metal of the precursor is spherical or substantially spherical. In one example, the closed pore in the metal of the precursor is substantially spherical, for example an oblate spheroid, wherein $a/2<c<a$, or a prolate spheroid, wherein $a<c<2a$. The morphology of the closed pore in the metal of the precursor may be determined using optical microscopy of mounted and polished metallographic samples in combination with image analysis software, for example using an OLYMPUS (RTM) DSX1000 Digital Microscope equipped with a DP27 digital camera in combination with OLYMPUS Stream image analysis software (available from OLYMPUS CORPORATION, Japan). In this way, a 2D morphological determination of the closed pore in the metal of the precursor may be provided. It should be understood that this determination of the morphology of the closed pore in the metal of the precursor is destructive and hence, morphological determination of closed pores in the metal of the precursor is of samples thereof and hence a statistical determination. Additionally and/or alternatively, the morphology of the closed pore in the metal of the precursor may be determined using computed tomography, CT, such as X-ray CT, for example using a XT H 225 ST (available from Nikon Metrology Europe NV, Belgium), having a 3 μm focal spot size up to 7 W and a 225 μm focal spot size at 225 W, and equipped with a Varian 2520Dx detector having 1950×1500 active pixels and a pixel size of 127 μm. In this way, a 3D morphological determination of the closed pore in the metal of the precursor may be provided, for example by reconstruction of 2D slices. It should be understood that this determination of the morphology of the closed pore in the metal of the precursor is non-destructive.

HIPing

The method comprises HIPing the precursor at the Nth temperature of the set of temperatures, at the Nth pressure of the set of pressures and for the Nth duration of the set of durations, thereby fabricating, at least in part, the article.

HIPing is known. Generally, HIPing is used to reduce the porosity and hence densify metals, thereby improving the mechanical properties and/or workability thereof. During HIPing, the precursor is exposed to an elevated temperature, typically between 480° C. for aluminium to over 1300° C. for nickel-based super alloys, at an elevated isostatic gas pressure, typically between 50 MPa and 300 MPa, for a given time. The gas is inert, typically Ar. The simultaneous heat and pressure reduces internal voids through a combination of plastic deformation, creep and diffusion bonding, resulting in close to 100% densification. HIPing may be used as a postprocessing step in AM.

It should be understood that the Nth temperature of the set of temperatures, the Nth pressure of the set of pressures and the Nth duration of the set of durations are determined according, at least in part, to the precursor, the metal and/or the article, as known to the skilled person. That is, the Nth temperature of the set of temperatures, the Nth pressure of the set of pressures and the Nth duration of the set of durations maybe as conventionally determined.

Regulating

Isostatically compressing the precursor and HIPing the compressed precursor comprises regulating the set of temperatures, the set of pressures and/or the set of durations to control, at least in part, the morphology of the closed pore. That is, in contrast to conventional HIPing, the set of temperatures, the set of pressures and/or the set of durations are regulated so as to control, at least in part, the morphology of the closed pore. For example, heating and/or pressurising to the Nth temperature of the set of temperatures and the Nth pressure of the set of pressures, respectively, maybe regulated so as to control, at least in part, the morphology of the closed pore. For example, cooling and/or depressurising from the Nth temperature of the set of temperatures and the Nth pressure of the set of pressures, respectively, maybe regulated so as to control, at least in part, the morphology of the closed pore.

In this way, by regulating the set of temperatures, the set of pressures and/or the set of durations during isostatically compressing and HIPing of the precursor, the morphology (i.e. shape) of the closed pore in the metal is controlled during isostatically compressing and HIPing, thereby defining the morphology of the residual closed pore in the article. Particularly, by controlling the morphology of the closed pore during isostatically compressing and HIPing in this way, the residual closed pore in the article may be relatively more spherical, thereby lessening deleterious effects due thereto. Notably, relatively more spherical, ideally spherical, closed pores result in relatively lower stress concentrations compared with ellipsoidal or toroidal closed pores, for example. In this way, the effect of the closed pore on the mechanical properties, for example the potentially deleterious effect on fatigue properties, of the fabricated article is attenuated compared with an article fabricated at least in part using conventional HIPing.

In one example, the closed pore in the metal of the article is spherical or substantially spherical. In one example, the closed pore in the metal of the article is an oblate spheroid, wherein a/2<c<a, or a prolate spheroid, wherein a<c<2a. The morphology of the closed pore in the metal of the article may be determined as described previously with respect to the closed pore in the metal of the precursor, mutatis mutandis. By using CT, for example, a change in the morphology of the closed pore in the metal as a result of the HIPing may be examined. In one example, a sphericity $\Psi_a$ of the closed pore in the metal of the article is within 50%, preferably within 20%, more preferably within 10% of a sphericity $\Psi_p$ of the closed pore in the metal of the precursor. Generally, the sphericity $\Psi$ of a closed pore having a volume V and a surface area A may be defined by:

$$\Psi = \frac{\pi^{\frac{1}{3}}(6V)^{\frac{2}{3}}}{A}$$

In one example, the sphericity $\Psi_a$ of the closed pore in the metal of the article is at least 0.9, preferably at least 0.95, more preferably at least 0.975, most preferably at least 0.99.

Heating and Pressurizing

In one example, regulating the set of temperatures, the set of pressures and/or the set of durations comprises regulating heating to the Nth temperature of the set of temperatures and/or regulating pressurising to the Nth pressure of the set of pressures, for example by pressurising to substantially (for example to at least 90% of) the Nth pressure of the set of pressures without heating and subsequently, heating to the Nth temperature of the set of temperatures. In this way, particles of the precursor are compressed isostatically from the onset of the HIPing, before significant heating, such that there is relatively little or no sintering or diffusion bonding, for example.

In one example, isostatically compressing the precursor comprises pressurizing the precursor from a zeroth pressure of the set of pressures, for example ambient pressure, to a first pressure of the set of pressures during a first duration of the set of durations. That is, the precursor is initially pressurised, for example isostatically, to the first pressure for the first duration.

In one example, a ratio of the first pressure to the Nth pressure is in a range from 1:5 to 1:1, preferably in a range from 1:4 to 19:20, more preferably in a range from 1:2 to 9:10, most preferably in a range from 2:3 to 17:20, for example 3:4. That is, the first pressure is relatively high compared with the HIPing pressure (i.e. the Nth pressure).

In one example, pressurizing the precursor from the zeroth pressure of the set of pressures to the first pressure of the set of pressures during the first duration of the set of durations comprises substantially isothermally, for example without applying heating or cooling and/or such that the temperature is constant within 5%, pressurizing the precursor from the zeroth pressure of the set of pressures to the first pressure of the set of pressures during the first duration of the set of durations, for example at a first temperature of the set of temperatures, for example ambient temperature. That is, the temperature is maintained during the initial pressurisation, for example maintained at approximately ambient temperature (i.e. the first temperature). This may be termed cold pressurisation, for example at a relatively high pressure as described above. In this way, particles of the precursor are compressed isostatically from the onset of the HIPing, before significant heating, such that there is relatively little or no sintering or diffusion bonding, for example. More generally, the cold pressurisation is without application of external heating i.e. without supplying heat to the precursor or the gas, noting that a temperature of the precursor and/or the gas may increase as a result of pressurisation. In contrast, cold pressurisation in conventional HIPing is typically at a relatively low pressure.

In one example, regulating the set of temperatures, the set of pressures and/or the set of durations comprises pressurizing the precursor from the first pressure of the set of pressures to the Nth pressure of the set of pressures during a second duration of the set of durations by heating the precursor to a second temperature of the set of temperatures. That is, the increase in pressure from the first pressure to the Nth pressure may be achieved by heating the precursor (and hence the gas) to the second temperature.

In one example, regulating the set of temperatures, the set of pressures and/or the set of durations comprises heating the precursor, for example from the second temperature of the set of temperatures, to the Nth temperature of the set of temperatures at the Nth pressure of the set of pressures. That is, the precursor may be heated to the HIPing temperature and the precursor is HIPed at the Nth temperature of the set of temperatures, at the Nth pressure of the set of pressures and for the Nth duration of the set of durations Cooling and Depressurizing In one example, the method comprises depressurising the article isothermally from the Nth pressure towards ambient pressure, and subsequently, cooling the depressurised article from the Nth temperature towards ambient temperature.

In one example, regulating the set of temperatures, the set of pressures and/or the set of durations comprises regulating cooling from the Nth temperature of the set of temperatures and/or regulating depressurising from the Nth pressure of the set of pressures, for example by depressurising substantially isothermally (for example such that the temperature is constant within 5%) from the Nth pressure of the set of pressures, for example to ambient pressure, and subsequently, cooling from the Nth temperature of the set of temperatures, for example towards ambient temperature. That is, the precursor depressurised while relatively hot and subsequently cooled at a relatively low pressure. In this way, spherodisation of closed pore is promoted since the precursor is maintained at a relatively high temperature during depressurising.

In one example, regulating the set of temperatures, the set of pressures and/or the set of durations comprises cooling the precursor from the Nth temperature of the set of temperatures to an N+1th temperature of the set of temperatures, optionally wherein the N+1th temperature of the set of temperatures is at least 80%, preferably at least 85%, more preferably at least 90% of the Nth temperature, most preferably at least 90% of the Nth temperature, for example at least 97.5% of the Nth temperature during an N+1th duration of the set of durations. That is, the precursor may be initially cooled though the temperature remains relatively high, compared with the Nth temperature.

In one example, cooling the precursor from the Nth temperature of the set of temperatures to the N+1th temperature of the set of temperatures comprises isobarically cooling the precursor from the Nth temperature of the set of temperatures to the N+1th temperature of the set of temperatures. That is, the initial cooling is without applying pressure or venting, for example.

In one example, regulating the set of temperatures, the set of pressures and/or the set of durations comprises depressurizing the precursor to an N+2nd pressure of the set of pressures during an N+2nd duration of the set of durations at a first depressurizing rate of a set of depressurizing rates and depressurizing the precursor to an N+3rd pressure of the set of pressures during an N+3rd duration of the set of durations at a second depressurizing rate of a set of depressurizing rates, and optionally depressurizing the precursor to an N+4th pressure of the set of pressures during an N+4th duration of the set of durations at a third depressurizing rate of a set of depressurizing rates, wherein the first depressurizing rate is slower than the second depressurizing rate and optionally, wherein the second depressurizing rate is slower than the third depressurizing rate, optionally wherein depressurizing the precursor comprises substantially isothermally, for example without applying heating or cooling and/or such that the temperature is constant within 5%, depressurizing the precursor, for example at the Nth temperature of the set of temperatures or the N+1th temperature of the said temperatures. That is, the precursor is depressurised at a relatively lower initial rate before subsequently depressurising at a relatively higher rate. Additionally and/or alternatively, in one example, the first depressurizing rate, the second depressurizing rate and optionally the third depressurizing rate are substantially equal or equal. Additionally and/or alternatively, in one example, the first depressurizing rate is faster than the second depressurizing rate and optionally, the second depressurizing rate is faster than the third depressurizing rate.

By maintaining the precursor at a relatively high temperature during depressurising, spherodisation of the closed pore is promoted, which may expand during the depressurising. It should be understood that depressurising may comprise continuous depressurising, for example progressive depressurising at a predetermined rate as defined by a flow rate controller, and/or step depressurising, for example depressurising by partially venting, holding for a predetermined duration and repeating. Generally, opportunity may be provided for the system to reach or approach reaching a degree of equilibrium by inserting periodic holds at constant applied pressure. In this way, the closed pore may expand to or towards an equilibrium expansion, as the applied pressure is reduced. If the rate of depressurisation is too fast, then there is the possibility of the closed pore tearing and a crack forming. However, since the pressure in the closed pore decreases as the closed pore expands, a driving force to expand will diminish such that there is a degree of self-correction. Nevertheless, dwells at constant pressure may be opportunities to allow this process to reach a degree of equilibration before another pressure reduction ramp. Hence, in one example, the pressurising the precursor to a pressure of the set of pressures comprises holding the precursor at the pressure for a duration of the set of durations, for example where in the duration is in a range from 0.05 hours to 1 hour, preferably in a range from 0.1 hours to 0.5 hours. Additionally and/or alternatively, depressurising maybe continuous or progressive, at a relatively low rate, during which such equilibration may occur.

In one example, regulating the set of temperatures, the set of pressures and/or the set of durations comprises cooling the precursor to an N+5th temperature of the set of temperatures during an N+5th duration of the set of durations at a first cooling rate of a set of cooling rates and cooling the precursor to an N+6th temperature of the set of temperatures during an N+6th duration of the set of durations at a second cooling rate of the set of cooling rates, wherein the first cooling rate is slower than the second cooling rate, optionally wherein cooling the precursor comprises isobarically cooling the precursor, for example at ambient pressure. That is, the precursor is cool at a relatively lower initial rate before subsequently cooling at a relatively higher rate. In this way, spherodisation of the closed pore during cooling is promoted.

Apparatus

The second aspect provides a hot isostatic press, HIP, apparatus for fabricating, at least in part, an article from a precursor thereof, wherein the apparatus is configured to:

HIP the precursor, comprising a metal having a closed pore therein, at an Nth temperature of a set of temperatures, at an Nth pressure of a set of pressures and for an Nth duration of a set of durations, thereby fabricating, at least in part, the article, by regulating the set of temperatures, the set of pressures and/or the set of durations to control, at least in part, a morphology of the closed pore.

The HIPing, the article, the precursor, the metal, the closed pore, the Nth temperature, the set of temperatures, the Nth pressure, the set of pressures, the duration, the set of durations, the fabricating, the regulating, the control and/or the morphology of the closed pore may be as described with respect to the first aspect.

Article

The third aspect provides an article formed according to the method of the first aspect and/or the apparatus of the second aspect.

In one example, the article comprises and/or is an aerospace component, such as an airframe component, a vehicle component, such as an engine component, or a medical component, such as an implantable medical device.

Computer, Computer Program and Non-Transient Computer-Readable Storage Medium

The fourth aspect provides a computer comprising a processor and a memory configured to implement, at least in part, a method according to the first aspect.

The fifth aspect provides a computer program comprising instructions which, when executed by a computer comprising a processor and a memory, cause the computer to perform a method, at least in part, according to the first aspect.

The sixth aspect provides a non-transient computer-readable storage medium comprising instructions which, when executed by a computer comprising a processor and a memory, cause the computer to perform a method, at least in part, according to the first aspect.

DEFINITIONS

Throughout this specification, the term "comprising" or "comprises" means including the component(s) specified but not to the exclusion of the presence of other components. The term "consisting essentially of" or "consists essentially of" means including the components specified but excluding other components except for materials present as impurities, unavoidable materials present as a result of processes used to provide the components, and components added for a purpose other than achieving the technical effect of the invention, such as colourants, and the like. The term "consisting of" or "consists of" means including the components specified but excluding other components. Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

BRIEF DESCRIPTION OF THE DRAWINGS

For a better understanding of the invention, and to show how exemplary embodiments of the same may be brought into effect, reference will be made, by way of example only, to the accompanying diagrammatic Figures, in which.

DETAILED DESCRIPTION OF DRAWINGS

Figure 1:
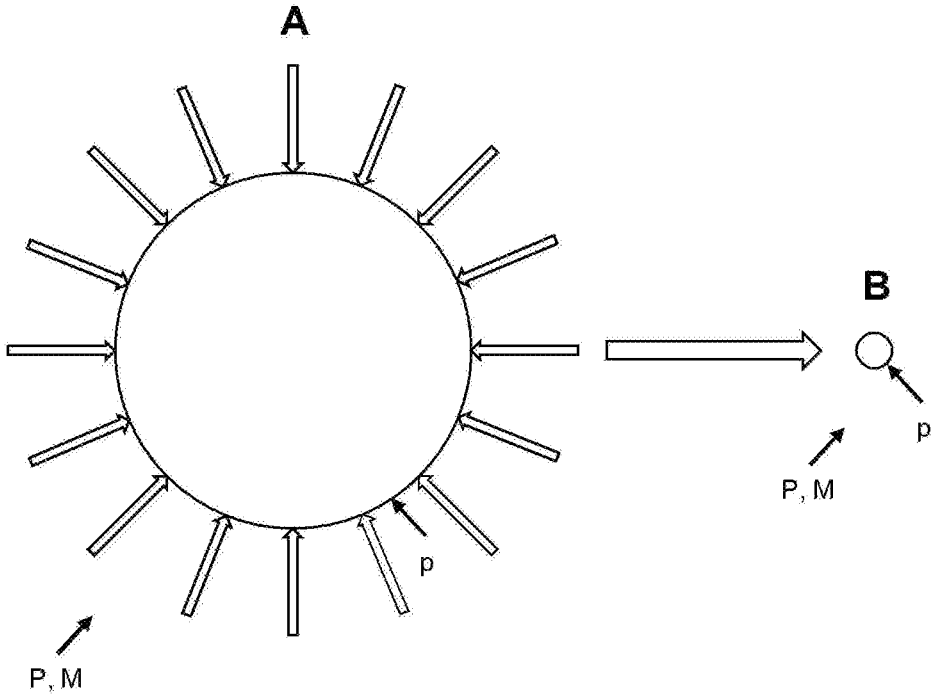
FIG. 1 schematically depicts isotropic HIPing of a precursor, comprising a metal having a closed pore therein.

FIG. 1 schematically depicts isotropic HIPing of a precursor P, comprising a metal M having a closed pore p therein. Particularly, FIG. 1 shows schematically the isostatic collapse of a spherical bubble (i.e. the closed pore p) from 0.05 mm diameter to 0.005 mm.

Firstly, the spherical bubbles (i.e. closed pores) may simply compress in a fully symmetrical manner (as illustrated schematically by the radial arrows, of equal length, indicating compression of the closed pore p by the isostatic HIP pressure applied on the precursor P) and simply become bubbles of much smaller diameter but still of spherical form. Typically, for a very large EIGA bubble of approximately 0.05 mm diameter wholly contained inside the largest EIGA particle in the specified PSD (i.e. a granule with diameter of 0.106 mm) undergoing HIP at 100 MPa pressure at 920° C. is expected to compress such that the internal pressure approaches the externally applied HIP pressure and the expectation is that such bubble will reduce in diameter by about an order of magnitude (i.e. from D=0.05 mm at A to D=0.005 mm at B). On removal of the HIP pressure there is a likelihood that some swelling will occur, particularly if the pressure is removed whilst still at very high temperature. However, the collapse of the bubble during HIP will also result in the surrounding surfaces diffusion bonding in the closed geometric condition and so any such swelling is expected to be relatively minor. This sort of bubble compression with only limited or negligible post-HIP swelling is seen as the most favourable outcome.

Figure 2:
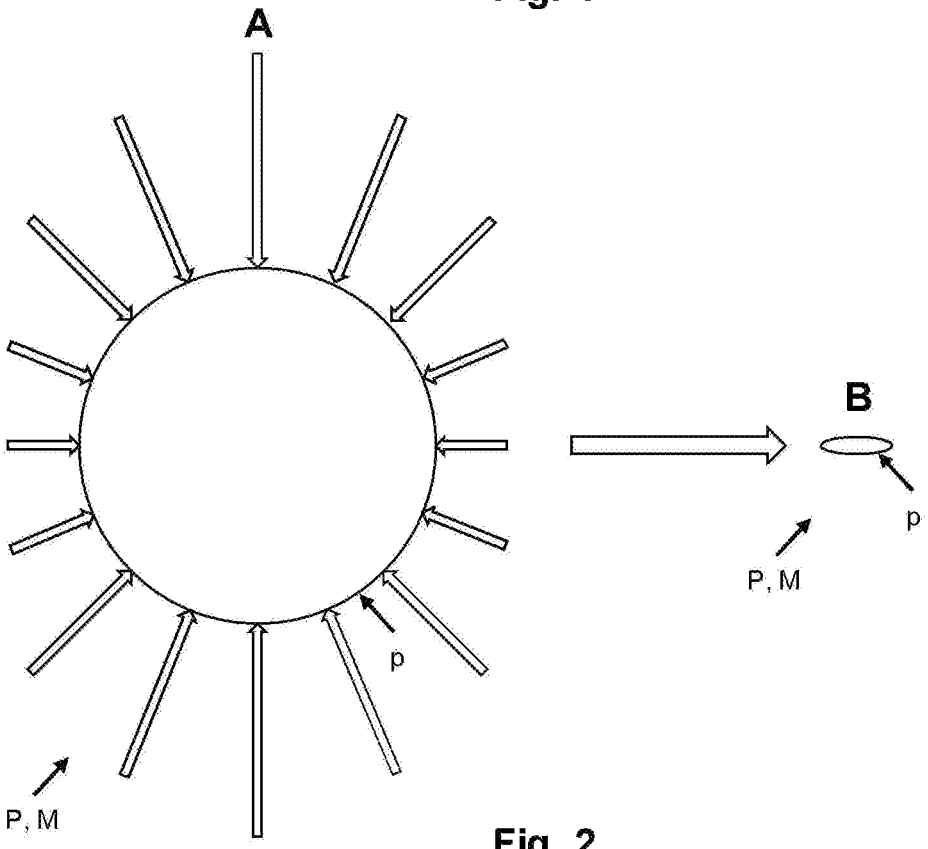
FIG. 2 schematically depicts anisotropic HIPing of a precursor, comprising a metal having a closed pore therein.

Secondly, FIG. 2 schematically depicts anisotropic HIPing of a precursor P, comprising a metal M having a closed pore p therein (the longer arrows depicting preferential direction of collapse). Particularly, FIG. 2 shows schematically the partially-isostatic collapse of a spherical bubble from 0.05 mm diameter (at A) (as illustrated schematically by the radial arrows, of non-equal length, indicating directional compression of the closed pore p by the anisotropic HIP pressure applied on the precursor P) to an ellipsoidal bubble (i.e. pressure is not uniformly applied in all directions) (at B).

So, the spherical bubble may compress in a partially asymmetrical manner to a squashed sphere with an ellipsoidal form. This behaviour is likely to occur if the pressure transmission through the surrounding grains is not perfectly uniform. The degree of asymmetrical collapse may, potentially, result in a quite exaggerated ellipsoidal form. This is of some concern since the internal gas pressure inside the ellipsoid after removal of the external HIP pressure will generate a higher stress concentration than for the purely spherical bubble. In a severely squashed ellipsoid, there is the possibility that the combination of internal pressure and geometrical stress concentration may cause the material to tear or cleave apart and for significant cracks to form at the oblately squashed radii.

Figure 3:
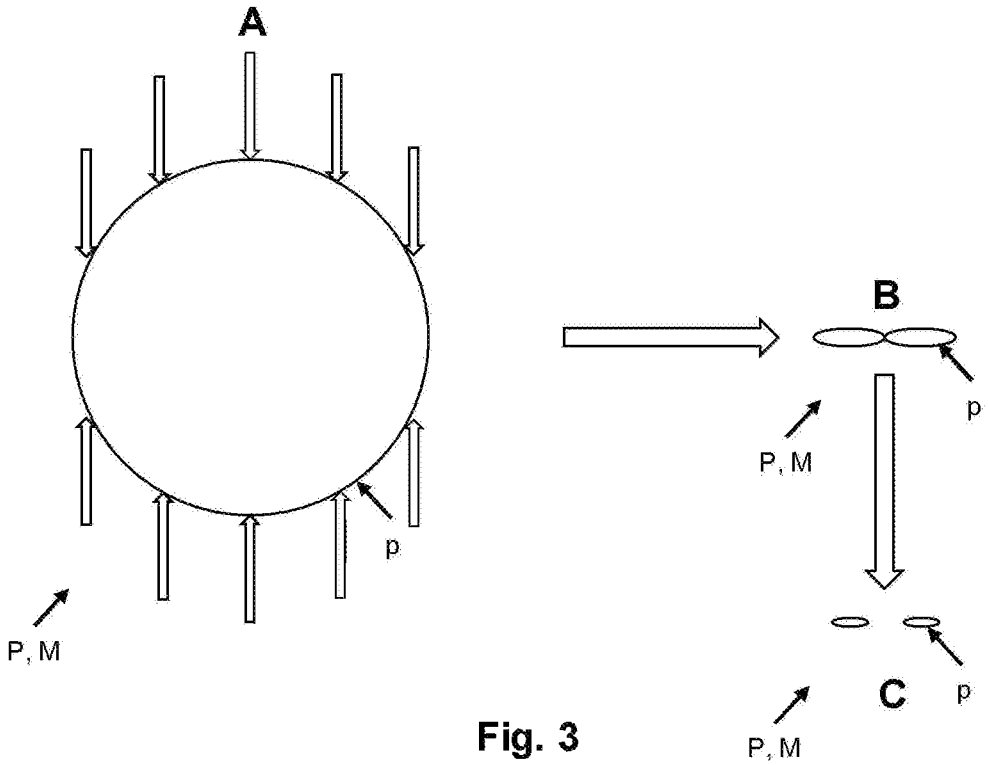
FIG. 3 schematically depicts uniaxial HIPing of a precursor, comprising a metal having a closed pore therein.

Thirdly, FIG. 3 schematically depicts a more extreme case of anisotropic bubble compression with uniaxial pressurisation occurring during the "HIPing process" of a precursor P, comprising a metal M having a closed pore p therein. Particularly, FIG. 3 shows schematically the uniaxial collapse of a spherical bubble from 0.05 mm diameter (at A) (as illustrated schematically by the parallel arrows, of equal length, indicating uniaxial compression of the closed pore p by the uniaxial HIP pressure applied on the precursor P) to a toroidal double bubble of doughnut form with a central diffusion bonded zone (at C via B).

So, if the transmission of HIP pressure is wholly or nearly-wholly uniaxial then the bubble may squash into a quasi 2-dimensional platelet where the opposing internal surfaces are brought into extremely close proximity. The HIP pressures involved are likely to result in the very central regions touching and diffusion bonding together and so a toroidal form is expected to result. This is considered the least desirable outcome and one which is expected to be of real harm to the material integrity.

The first approach is to "encourage" all particles to be compressed isostatically from the onset (i.e. before significant heating) and so when there is a significant temperature increase there is also limited opportunity for sintering to commence without all surfaces also being in intimate contact ensuring an uninterrupted pressure pathway throughout the powder system.

Hence, the method according to the first aspect may be better served by applying a very high level of "cold-pressurisation" before the onset of heating rather than the standard approach used in HIP of pre-charging the pressure vessel with argon to only a relatively low initial gas pressure and then using the increase in temperature to effect the majority of the required pressure increase. The latter approach is generally used in the HIP industry where the initial cold-pressurisation is capped and would not exceed 25% of the final target pressure. For titanium Powder HIP, the final target pressure will be at least 100 MPa and so the initial pressure used will be no more than 25 MPa. This pressure cap ensures that argon gas is not wasted since any cold pressurisation (i.e. ambient) above 25% of final target pressure will necessitate subsequent venting as the pressure builds during the heating phase. For example, and according to the Universal Gas Equation, if the final target temperatures and pressures are 920° C. and 100 MPa then any cold-pressurisation (i.e. at, say 20° C.) above a pressure of 24.56 MPa would be expected to either result in excess pressure or a need to vent gas in order to stay within the target pressure range. In contrast, the method according to the first aspect may be to cold pressurise to approximately 75% of the target pressure (e.g. 75 MPa) and then heat up to 920° C. with the expectation that as the temperature reaches approximately 118° C. the pressure will approach the final target pressure of 100 MPa and that venting will then be required for the remainder of the heat-up phase. In so doing it is anticipated that as the titanium starts to deform plastically and intra-granular bubbles start to collapse then there will be uniform isostatic pressure across the powder system and asymmetric bubble collapse will not occur to any significant level.

The second approach is to amend the way in which the pressure and temperature is reduced once the HIP-dwell at maximum pressure and temperature is concluded. In the prior art the norm is to reduce temperature and pressure concurrently. As pressure is vented so there will an expansion of the HIP argon gas and temperature will reduce. This will aid cooling. In addition, "gas quenching" may also applied (i.e. injecting cold gas) to accelerate the cooling process. The proposed novel approach is to reduce the HIP pressure whilst maintaining the temperature at a high level in order to encourage re-spherodisation of any ellipsoidal bubbles that may be present. This may be done either substantially isothermally, for example without applying heating or cooling, at the full HIP temperature (e.g. typically 920° C. for titanium alloys) or, alternatively, a level of pre-cooling to an intermediate temperature whilst remaining at full HIP pressure may be applied before then substantially isothermally, for example without applying heating or cooling, (i.e. at the intermediate reduced temperature) lowering the HIP pressure. The latter approach will provide an increase in the flow stress of the titanium and provide a degree of resilience in order to better withstand the ensuing positive pressure differential inside the entrapped argon bubbles once HIP de-pressurisation commences. Otherwise, there will be a risk of damage occurring. Either way, the rate of HIP vessel de-pressurisation is to be controlled such that the initial rate of pressure decay is more limited and is allowed to progressively increase according to a prescribed process. Only once the HIP vessel pressure has been substantially reduced will the full reduction in temperature be implemented.

The rationale for the modified de-pressurisation to a substantially reduced level (either at the full HIP temperature or at an intermediate and partially reduced temperature) followed by the main cooling phase is to enable the spherodisation of any ellipsoidal gas bubbles that may have been formed despite the use of the cold-pressurisation step. The controlled de-pressurisation of the HIP vessel is therefore a precautionary measure but is one that could also be used in the absence of a cold-pressurisation step in order to mitigate ellipsoidal gas bubble re-inflation occurring in a damaging manner (see below). The concern, otherwise, would be that without the precautionary progressive de-pressurisation at high temperature any sudden decrease in HIP pressure that occurs during the cooling phase could give rise to an alarmingly high positive pressure differential between the inside of the gas bubble and the HIPed component. This could then create a tendency for tearing or cleavage rather than the more desirable slow re-inflation of the bubble and the formation of cracks or at the least for the preservation of non-spherodised gas bubbles that could then act as sites for premature fatigue crack initiation in the component during service.

Figure 4:
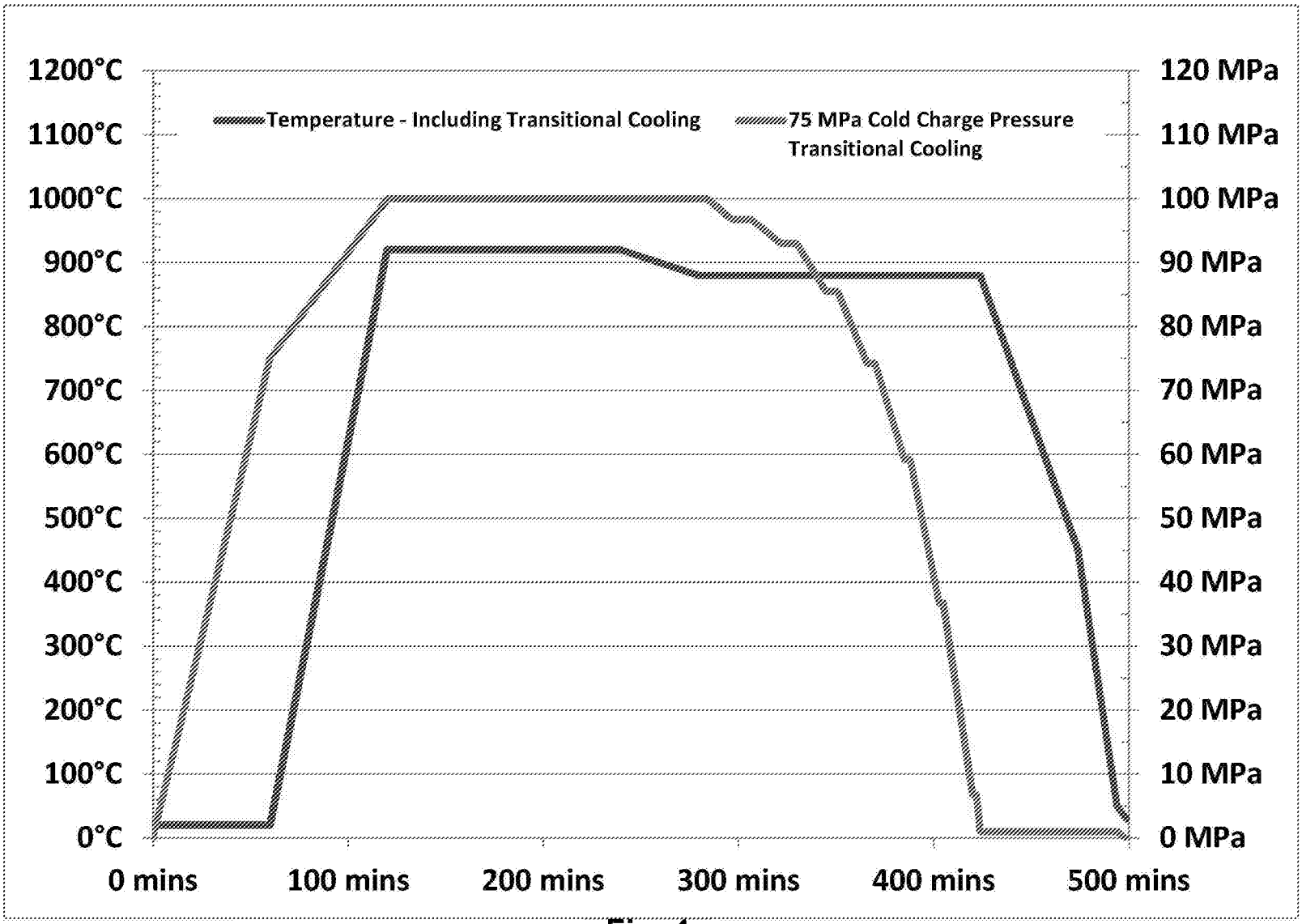
FIG. 4 schematically depicts a method of according to an exemplary embodiment.

FIG. 4 schematically depicts a method of according to an exemplary embodiment. Particularly, FIG. 4 shows a HIP Temperature & Pressure Curve for a cycle in Table 3 ("Cold Charge" to 75% of final target pressure (75 MPa) and 40° C. of Isobaric cooling prior to a controlled (progressively increasing rate of de-pressurisation). It should be noted that the Stabilisation Hold times in Table 3 can be extended in order to provide a margin of safety and allow gas bubbles to re-inflate to the optimum level before the next stage of de-pressurisation commences.

| Pressure MPa | Temperature ° C. | Temperature K | Time Step mins | Total Time mins | Comments | Pressure Ramp Rate MPa/min |
|---|---|---|---|---|---|---|
| 0 | 20 | 293 | 0 | 0 | Start | 0.000 |
| 75 | 20 | 293 | 60 | 60 | Cold Pressurisation to 75% | 1.250 |
| 100 | 920 | 1193 | 60 | 120 | Heating to full HIP Temperature and Thermal Self Pressurisation | 0.417 |
| 100 | 920 | 1193 | 120 | 240 | Dwell at full HIP Temperature & Pressure | 0.000 |
| 100 | 880 | 1153 | 40 | 280 | Isobaric Cooling to 880° C. | 0.000 |
| 100 | 880 | 1153 | 4 | 284 | 4 mins Thermal Stabilisation Hold | 0.000 |
| 96.75 | 880 | 1153 | 13 | 297 | sothermal De-pressurisation (Step 1) | −0.250 |
| 96.75 | 880 | 1153 | 10 | 307 | 10 mins Pressure Stabilisation Hold | 0.000 |
| 93 | 880 | 1153 | 15 | 322 | Isothermal De-pressurisation (Step 2) | −0.250 |
| 93 | 880 | 1153 | 8 | 330 | 8 mins Pressure Stabilisation Hold | 0.000 |
| 85.5 | 880 | 1153 | 15 | 345 | Isothermal De-pressurisation (Step 3) | −0.500 |
| 85.5 | 880 | 1153 | 6 | 351 | 6 mins Pressure Stabilisation Hold | 0.000 |
| 74.25 | 880 | 1153 | 15 | 366 | Isothermal De-pressurisation (Step 4) | −0.750 |
| 74.25 | 880 | 1153 | 4 | 370 | 4 mins Pressure Stabilisation Hold | 0.000 |
| 59.25 | 880 | 1153 | 15 | 385 | Isothermal De-pressurisation (Step 5) | −1.000 |
| 59.25 | 880 | 1153 | 3 | 388 | 3 mins Pressure Stabilisation Hold | 0.000 |
| 36.75 | 880 | 1153 | 15 | 403 | Isothermal De-pressurisation (Step 6) | −1.500 |
| 36.75 | 880 | 1153 | 2 | 405 | 2 mins Pressure Stabilisation Hold | 0.000 |
| 6.75 | 880 | 1153 | 15 | 420 | Isothermal De-pressurisation (Step 7) | −2.000 |
| 6.75 | 880 | 1153 | 2 | 422 | 2 mins Pressure Stabilisation Hold | 0.000 |
| 1 | 880 | 1153 | 2 | 424 | Isothermal De-pressurisation (Step 8) | −2.875 |
| 1 | 450 | 723 | 50 | 474 | First Stage Cooling to 450° C. | 0.000 |
| 1 | 50 | 323 | 20 | 494 | Second Stage Cooling to 50° C. | 0.000 |
| 0 | 30 | 303 | 5 | 499 | Cycle End | −0.200 |

Table 3: HIP Cycle using a "Cold Charge" to 75% of final target pressure (75 MPa) and 40° C. of isobaric cooling prior to controlled (progressively increasing) rate of de-pressurisation (75 MPa Cold Charge Pressure Transitional Cooling & Extended Stabilisation Holds).

Figure 5:
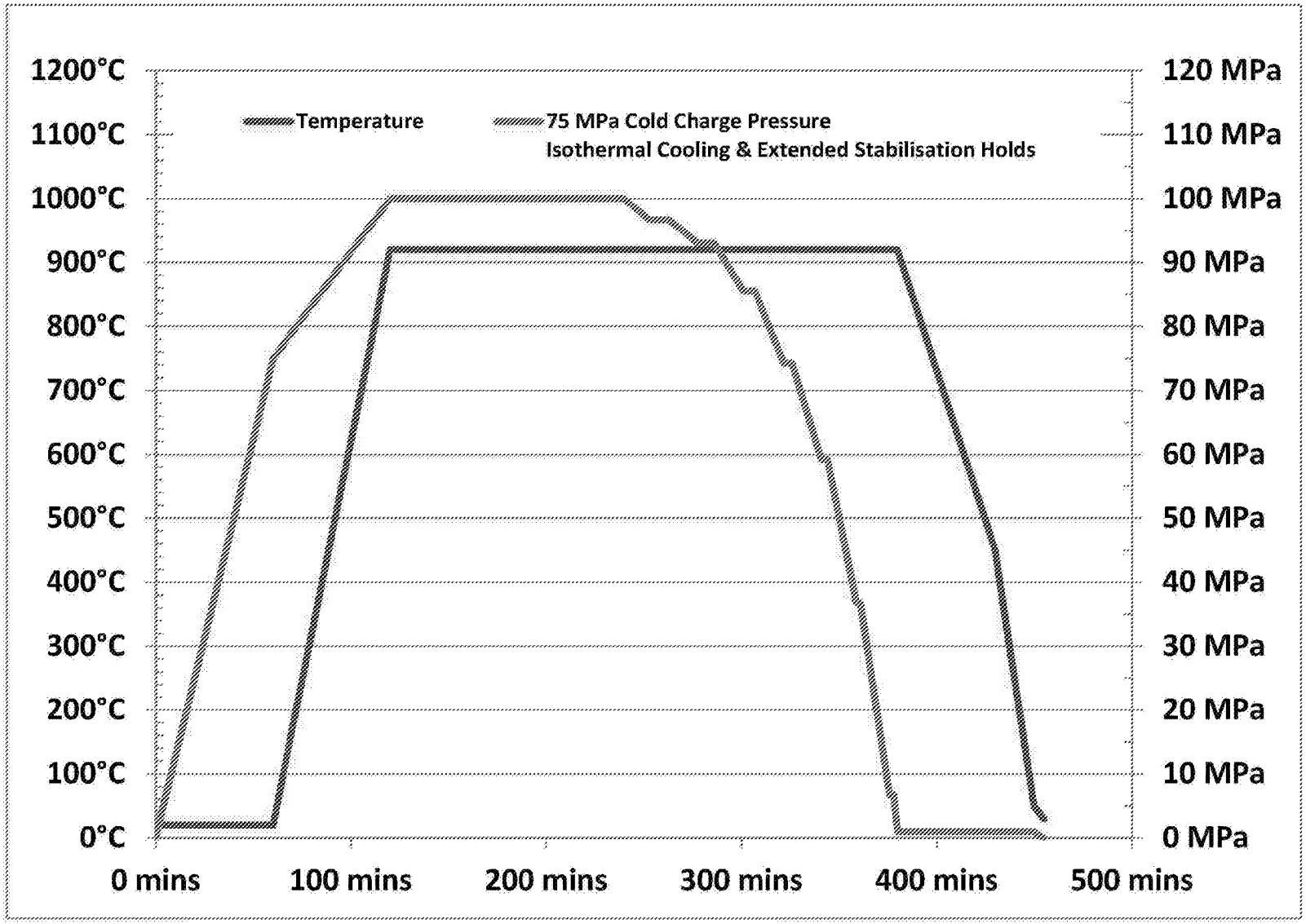
FIG. 5 schematically depicts a method of according to an exemplary embodiment.

FIG. 5 schematically depicts a method of according to an exemplary embodiment. Particularly, FIG. 5 shows a HIP Temperature & Pressure Curve for cycle in Table 4 ("Cold Charge" to 75% of final target pressure (75 MPa and no Isobaric cooling prior to a controlled (progressively increasing) rate of de-pressurisation).

| Pressure MPa | Temperature ° C. | Temperature K | Time Step mins | Total Time mins | Comments | Pressure Ramp Rate MPa/min |
|---|---|---|---|---|---|---|
| 0 | 20 | 293 | 0 | 0 | Start | 0.0000 |
| 75 | 20 | 293 | 60 | 60 | Cold Pressurisation to 75% | 1.2500 |
| 100 | 920 | 1193 | 60 | 120 | Heating to full HIP Temperature and Thermal Pressurisation | 0.4167 |
| 100 | 920 | 1193 | 120 | 240 | Dwell at full HIP Temperature & Pressure | 0.0000 |
| 96.75 | 920 | 1193 | 13 | 253 | Isothermal De-pressurisation (Step 1) | −0.2500 |
| 96.75 | 920 | 1193 | 10 | 263 | 10 mins Pressure Stabilisation Hold | 0.0000 |
| 93 | 920 | 1193 | 15 | 278 | Isothermal De-pressurisation (Step 2) | −0.2500 |
| 93 | 920 | 1193 | 8 | 286 | 8 mins Pressure Stabilisation Hold | 0.0000 |
| 85.50 | 920 | 1193 | 15 | 301 | sothermal De-pressurisation (Step 3) | −0.5000 |
| 85.50 | 920 | 1193 | 6 | 307 | 6 mins Pressure Stabilisation Hold | 0.0000 |
| 74.25 | 920 | 1193 | 15 | 322 | Isothermal De-pressurisation (Step 4) | −0.7500 |
| 74.25 | 920 | 1193 | 4 | 326 | 4 mins Pressure Stabilisation Hold | 0.0000 |
| 59.25 | 920 | 1193 | 15 | 341 | sothermal De-pressurisation (Step 5) | −1.0000 |
| 59.25 | 920 | 1193 | 3 | 344 | 3 mins Pressure Stabilisation Hold | 0.0000 |
| 36.75 | 920 | 1193 | 15 | 359 | Isothermal De-pressurisation (Step 6) | −1.5000 |
| 36.75 | 920 | 1193 | 2 | 361 | 2 mins Pressure Stabilisation Hold | 0.0000 |
| 6.75 | 920 | 1193 | 15 | 376 | Isothermal De-pressurisation (Step 7) | −2.0000 |
| 6.75 | 920 | 1193 | 2 | 378 | 2 mins Pressure Stabilisation Hold | 0.0000 |
| 1 | 920 | 1193 | 2 | 380 | Isothermal De-pressurisation (Step 8) | −2.8750 |
| 1 | 450 | 723 | 50 | 430 | First Stage Cooling to 450° C. | 0.0000 |
| 1 | 50 | 323 | 20 | 450 | Second Stage Cooling to 50° C. | 0.0000 |
| 0 | 30 | 303 | 5 | 455 | Cycle End | −0.2000 |

Table 4: HIP Cycle using a "Cold Charge" to 75% of final target pressure (75 MPa) with no isobaric cooling prior to controlled (progressively increasing) rate of de-pressurisation (75 MPa Cold Charge Pressure Isothermal Cooling & Extended Stabilisation Holds).

Figure 6:
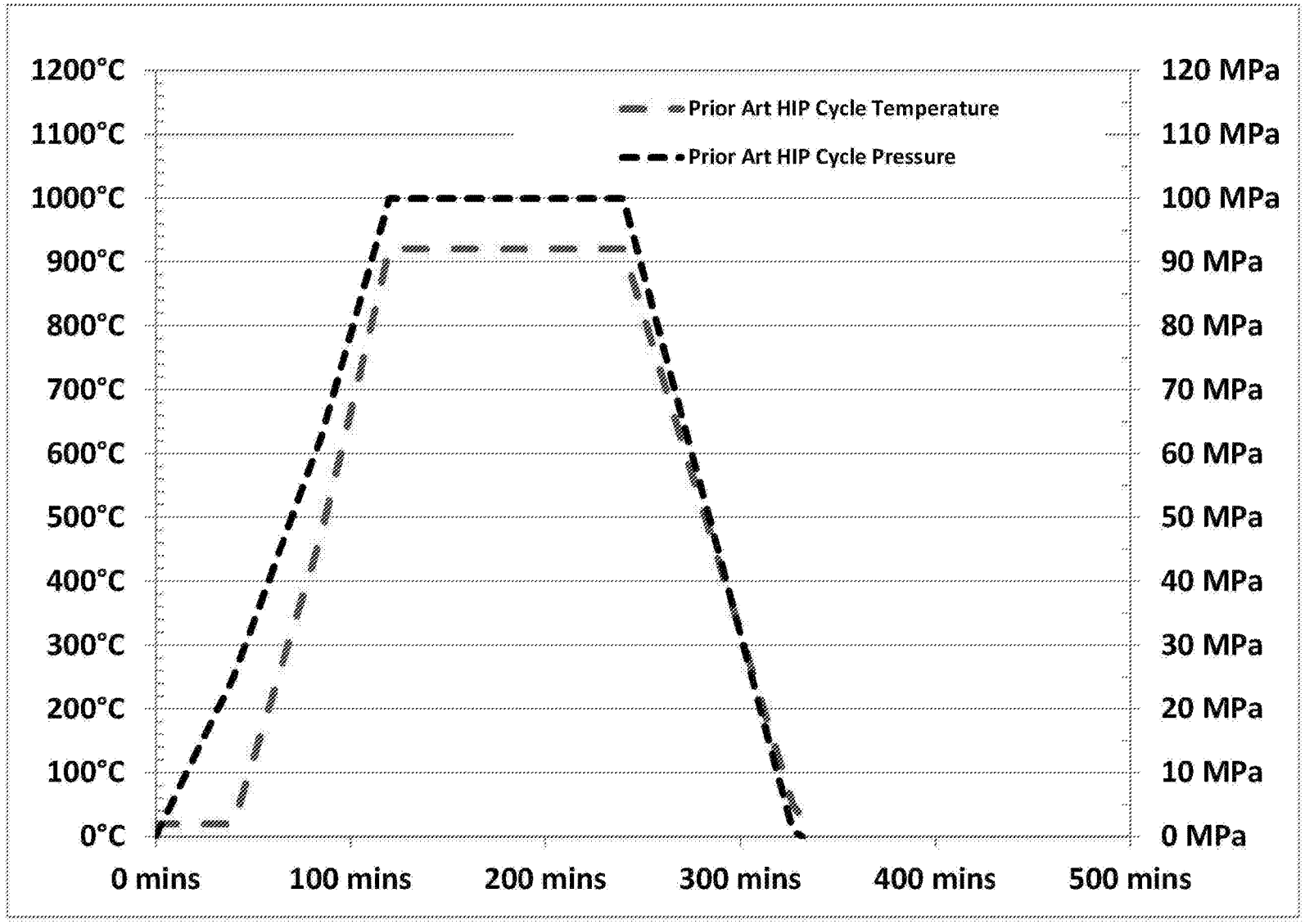
FIG. 6 schematically depicts a conventional method.

FIG. 6 schematically depicts a conventional method. Particularly, FIG. 6 shows a conventional HIP Cycle using a "Cold Charge" to 25% of final target pressure (25 MPa) with concurrent cooling and de-pressurisation (see Table 5).

| Pressure MPa | Temperature ° C. | Temperature K | Time Step mins | Total Time mins | Comments | Pressure Ramp Rate MPa/min |
|---|---|---|---|---|---|---|
| 0 | 20 | 293 | 0 | 0 | Start | 0.000 |
| 25 | 20 | 293 | 40 | 40 | Cold Pressurisation to 25 MPa | 0.625 |
| 62.5 | 470 | 743 | 45 | 85 | Intermediate Temperature & Pressure | 0.833 |
| 100 | 920 | 1193 | 35 | 120 | Heating to full HIP Temperature and Thermal Self Pressurisation | 1.071 |
| 100 | 920 | 1193 | 120 | 240 | Dwell at full HIP Temperature & Pressure | 0.000 |
| 1 | 50 | 323 | 87 | 327 | Combined Cooling and De-pressurisation | −1.138 |
| 0 | 30 | 303 | 5 | 332 | Cycle End | −0.200 |

Table 5: Conventional HIP Cycle using a "Cold Charge" to 25% of final target pressure (25 MPa) with concurrent cooling and de-pressurisation (see FIG. 6).

Figure 7:
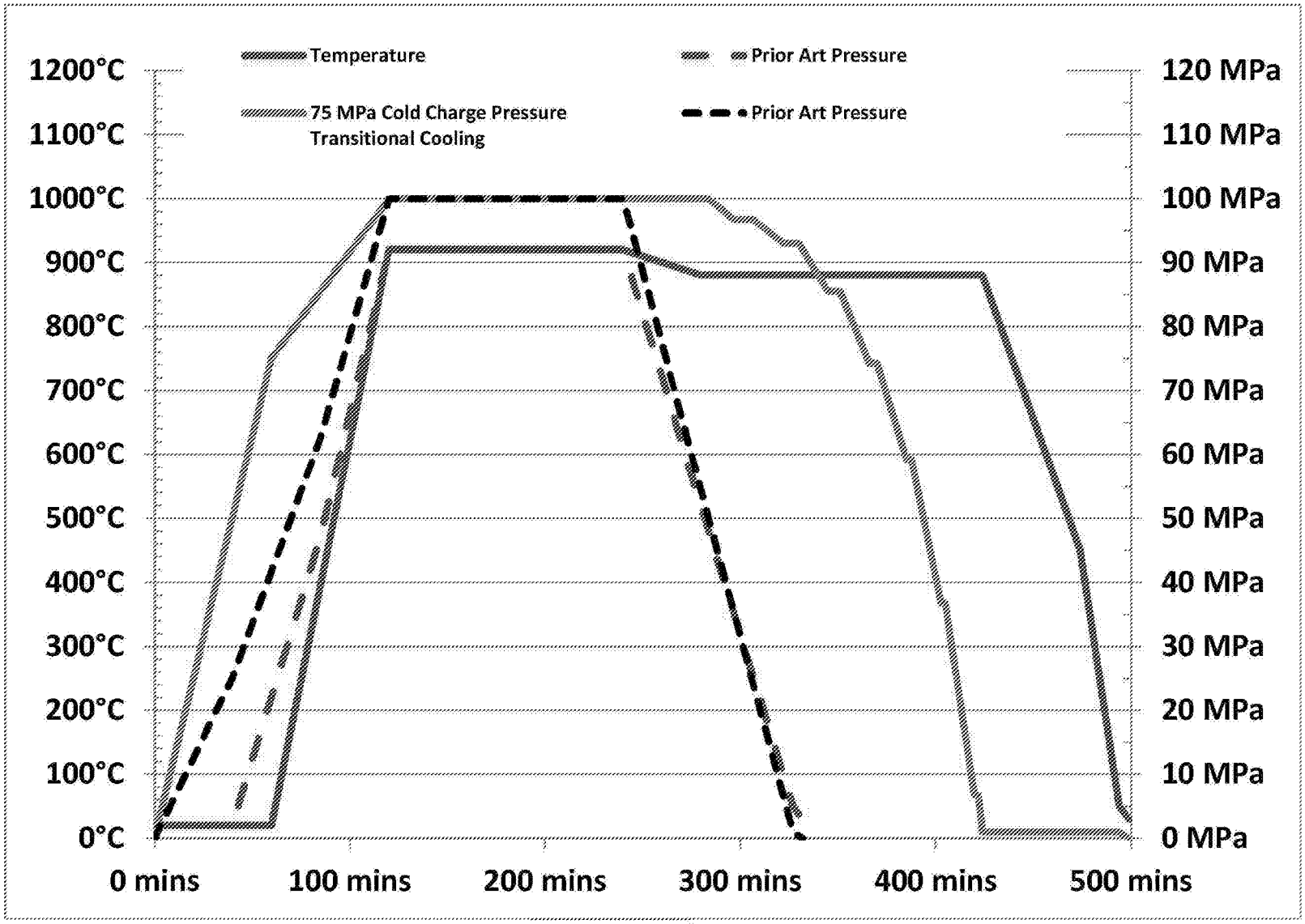
FIG. 7 schematically depicts a method of according to an exemplary embodiment and a conventional method.

FIG. 7 schematically depicts a method of according to an exemplary embodiment and a conventional method. Particularly, FIG. 7 shows a comparison between the preferred embodiment and the conventional HIP cycle of FIG. 6.

It will be noted that the conventional HIP cycle is a shorter cycle, see FIG. 7. The preferred embodiment is the longest cycle as this also included the isobaric cooling phase that adds approximately 44 minutes to the cycle without isobaric cooling and is 167 minutes longer than the conventional process described.

Applying the conventional process to Powder HIP parts made from EIGA powder will potentially result in highly ellipsoidal and even toroidal gas bubbles and the prospect of cracks and/or tears occurring either during the process is during subsequent high temperature heat treatments or service exposure. The enhanced process also has applicability to other processes that use HIP as an ameliorating treatment (e.g. for the elimination of internal porosity in additively manufactured parts). This includes both the Laser and Electron Beam Selective Powder Bed processes. In the case of Laser Powder Bed there is the prospect of argon gas entrapment occurring either through use of a less than optimum set of laser build parameters where the argon process gas that is used becomes entrained in the porosity created by the inferior build process, or through argon entrapment already present in the powder stock. The latter is less likely as the SLM process typically uses 15-45 micron powder grade and is generally considered immune from intra-granular argon bubbles associated with the EIGA route. In contrast, the Electron Beam Powder Bed process typically uses coarser powder and may well contain intra-granular (i.e. within the precursor gas particles) argon gas entrapment. This form of gas entrapment is known to be capable of surviving the EB melting process despite the use of a vacuum environment. This invention therefore has broader applicability than solely for Powder HIP.

Figure 8:
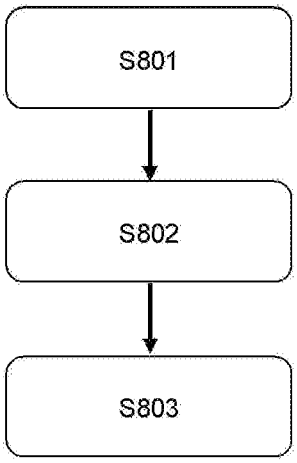
FIG. 8 schematically depicts a method of according to an exemplary embodiment.

FIG. 8 schematically depicts a method of according to an exemplary embodiment.

The method is of fabricating, at least in part, an article from a precursor thereof.

At S801, the method comprises providing the precursor, wherein the precursor comprises a metal having a closed pore therein.

At S802, the method comprises isostatically compressing the precursor, thereby providing a compressed precursor; and hot isostatic pressing, HIPing, the compressed precursor at an Nth temperature of a set of temperatures, at an Nth pressure of a set of pressures and for an Nth duration of a set of durations, thereby fabricating, at least in part, the article.

Figure 9:
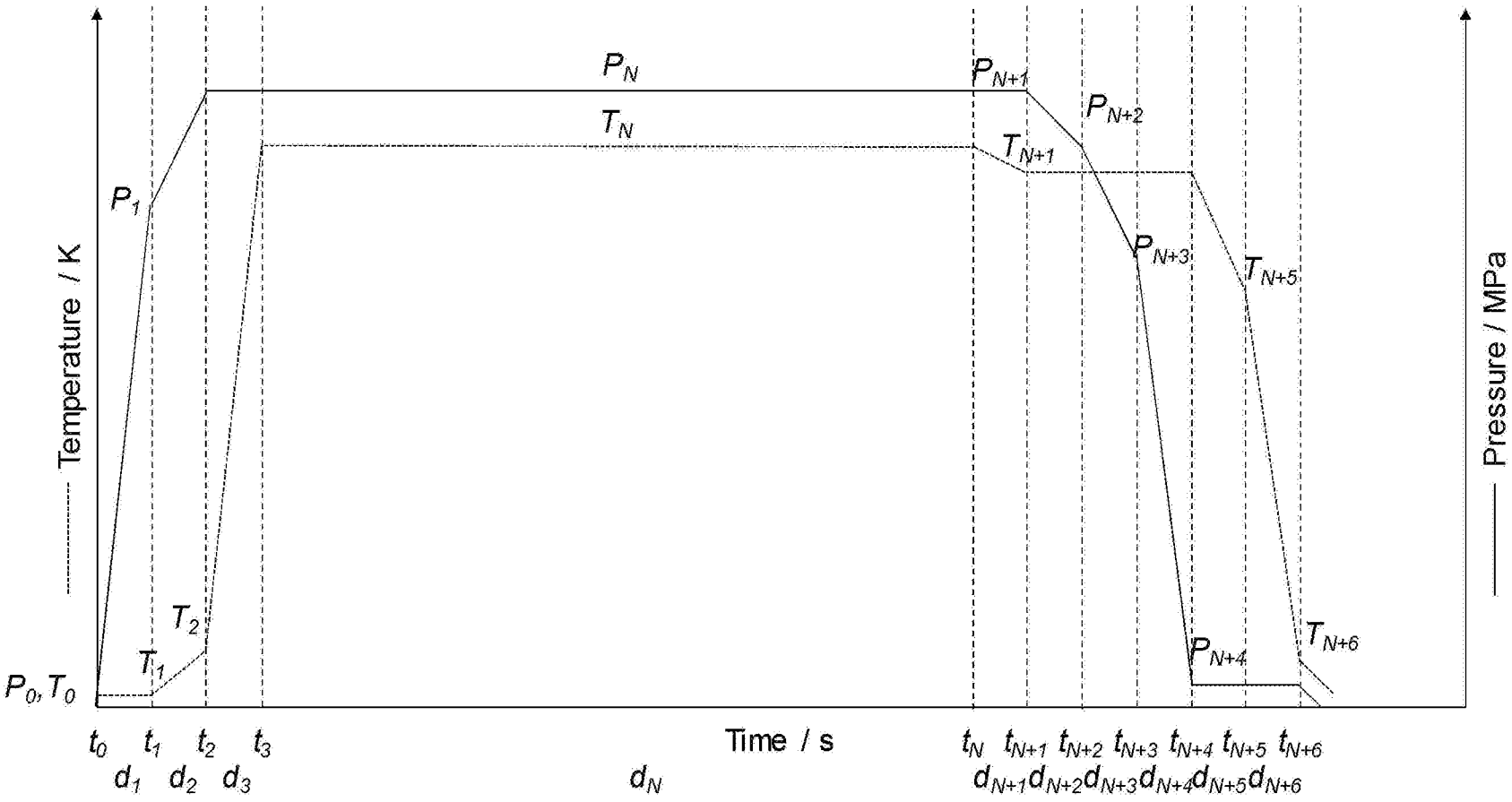
FIG. 9 schematically depicts the method of FIG. 8, in more detail.

FIG. 9 schematically depicts the method of FIG. 8, in more detail, as summarised in Table 6.

| Time/s | Temperature/K | Pressure/MPa | Duration/s |
|---|---|---|---|
| $t_0$ | $T_0$ | $P_0$ | |
| $t_1$ | $T_1 \approx T_0$ | $P_0 << P_1 \approx 0.75P_0$ | $d_1 = t_1 - t_0$ |
| $t_2$ | $T_2 > T_1$ | $P_N$ | $d_2 = t_2 - t_1$ |
| $t_3$ | $T_N >> T_2$ | $P_N$ | $d_3 = t_3 - t_2$ |
| $t_N$ | $T_N$ | $P_N$ | $d_N = t_N - t_3$ |
| $t_{N+1}$ | $T_{N+1} = 0.95T_N$ | $P_{N+1} \approx P_N$ | $d_{N+1} = t_{N+1} - t_N$ |
| $t_{N+2}$ | $T_{N+1}$ | $P_{N+2} < P_{N+1}$ | $d_{N+2} = t_{N+2} - t_{N+1}$ |
| $t_{N+3}$ | $T_{N+1}$ | $P_{N+3} < P_{N+2}$ | $d_{N+3} = t_{N+3} - t_{N+2}$ |
| $t_{N+4}$ | $T_{N+1}$ | $P_0 \approx P_{N+4} << P_{N+3}$ | $d_{N+4} = t_{N+4} - t_{N+3}$ |
| $t_{N+5}$ | $T_{N+5} < T_{N+1}$ | $P_0 \approx P_{N+4}$ | $d_{N+5} = t_{N+5} - t_{N+4}$ |
| $t_{N+6}$ | $T_0 \approx T_{N+6} << T_{N+5}$ | $P_0 \approx P_{N+4}$ | $d_{N+6} = t_{N+6} - t_{N+5}$ |

Table 6: HIP Cycle using a cold charge to 75% of final target pressure and isobaric cooling prior to controlled (progressively increasing) rate of de-pressurisation.

In this example, regulating the set of temperatures, the set of pressures and/or the set of durations comprises regulating heating to the Nth temperature of the set of temperatures and/or regulating pressurising to the Nth pressure of the set of pressures, for example by pressurising to substantially the Nth pressure of the set of pressures without heating and subsequently, heating to the Nth temperature of the set of temperatures.

In this example, regulating the set of temperatures, the set of pressures and/or the set of durations comprises pressurizing the precursor from a zeroth pressure of the set of pressures, for example ambient pressure, to a first pressure of the set of pressures during a first duration of the set of durations.

In this example, a ratio of the first pressure to the Nth pressure is 3:4.

In this example, pressurizing the precursor from the zeroth pressure of the set of pressures to the first pressure of the set of pressures during the first duration of the set of durations comprises substantially isothermally, for example without applying heating or cooling, pressurizing the precursor from the zeroth pressure of the set of pressures to the first pressure of the set of pressures during the first duration of the set of durations, for example at a first temperature of the set of temperatures, for example ambient temperature.

In this example, regulating the set of temperatures, the set of pressures and/or the set of durations comprises pressurizing the precursor from the first pressure of the set of pressures to the Nth pressure of the set of pressures during a second duration of the set of durations by heating the precursor to a second temperature of the set of temperatures.

In this example, regulating the set of temperatures, the set of pressures and/or the set of durations comprises heating the precursor, for example from the second temperature of the set of temperatures, to the Nth temperature of the set of temperatures at the Nth pressure of the set of pressures.

In this example, regulating the set of temperatures, the set of pressures and/or the set of durations comprises regulating cooling from the Nth temperature of the set of temperatures and/or regulating depressurising from the Nth pressure of the set of pressures, for example by depressurising substantially isothermally from the Nth pressure of the set of pressures, for example to ambient pressure, and subsequently, cooling from the Nth temperature of the set of temperatures, for example towards ambient temperature.

In this example, regulating the set of temperatures, the set of pressures and/or the set of durations comprises cooling the precursor from the Nth temperature of the set of temperatures to an N+1th temperature of the set of temperatures, optionally wherein the N+1th temperature of the set of temperatures is at least 80%, preferably at least 85%, more preferably at least 90% of the Nth temperature, during an N+1th duration of the set of durations.

In this example, cooling the precursor from the Nth temperature of the set of temperatures to the N+1th temperature of the set of temperatures comprises isobarically cooling the precursor from the Nth temperature of the set of temperatures to the N+1th temperature of the set of temperatures.

In this example, regulating the set of temperatures, the set of pressures and/or the set of durations comprises depressurizing the precursor to an N+2nd pressure of the set of pressures during an N+2nd duration of the set of durations at a first depressurizing rate of a set of depressurizing rates and depressurizing the precursor to an N+3rd pressure of the set of pressures during an N+3rd duration of the set of durations at a second depressurizing rate of a set of depressurizing rates, and optionally depressurizing the precursor to an N+4th pressure of the set of pressures during an N+4th duration of the set of durations at a third depressurizing rate of a set of depressurizing rates, wherein the first depressurizing rate is slower than the second depressurizing rate and optionally, wherein the second depressurizing rate is slower than the third depressurizing rate, optionally wherein depressurizing the precursor comprises substantially isothermally, for example without applying heating or cooling, depressurizing the precursor, for example at the Nth temperature of the set of temperatures or the N+1th temperature of the said temperatures.

In this example, regulating the set of temperatures, the set of pressures and/or the set of durations comprises cooling the precursor to an N+5th temperature of the set of temperatures during an N+5th duration of the set of durations at a first cooling rate of a set of cooling rates and cooling the precursor to an N+6th temperature of the set of temperatures during an N+6th duration of the set of durations at a second cooling rate of the set of cooling rates, wherein the first cooling rate is slower than the second cooling rate, optionally wherein cooling the precursor comprises isobarically cooling the precursor, for example at ambient pressure.

Although a preferred embodiment has been shown and described, it will be appreciated by those skilled in the art that various changes and modifications might be made without departing from the scope of the invention, as defined in the appended claims and as described above.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at most some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A method of fabricating an article from a precursor thereof, the method comprising:

providing the precursor, comprising encapsulating a powder of an α+β Ti alloy in a container, wherein the powder is formed by electrode induction gas atomisation;

cold pressurisation of the precursor by isostatically compressing the precursor at a first pressure, thereby providing a compressed precursor; and hot isostatic pressing, the compressed precursor at an Nth pressure in a range from 75 MPa to 150 MPa and at an Nth temperature in a range from 850° C. to 950° C., thereby fabricating the article;

wherein a ratio of the first pressure to the Nth pressure is in a range from 1:2 to 9:10.

2. The method according to claim 1, wherein a ratio of the first pressure to the Nth pressure is in a range from 2:3 to 17:20.

3. The method according to claim 1, wherein cold pressurisation of the precursor by isostatically compressing the precursor at the first pressure is without applying heating or cooling.

4. The method according to claim 1, wherein particles of the powder comprise entrapped bubbles of argon.

5. The method according to claim 4, wherein the particles of the powder have a dimension of at least 50 μm.

6. The method according to claim 1, comprising depressurising the article isothermally from the Nth pressure towards ambient pressure, and subsequently, cooling the depressurised article from the Nth temperature towards ambient temperature.

7. The method according to claim 6, wherein depressurising the article isothermally from the Nth pressure towards ambient pressure comprises depressurising the article isothermally from the Nth pressure to ambient pressure.

8. The method according to claim 6, wherein cooling the depressurised article from the Nth temperature towards ambient temperature comprises cooling at a first cooling rate and subsequently, cooling at a second cooling rate, wherein the first cooling rate is slower than the second cooling rate.

9. The method according to claim 6, wherein cooling the article comprises isobarically cooling the article.

10. The method according to claim 9, wherein isobarically cooling the article is at ambient pressure.

11. The method according to claim 6, wherein cooling the depressurised article from the Nth temperature towards ambient temperature comprises isobarically cooling the article from the Nth temperature to an N+1th temperature, wherein the N+1th temperature is at least 80% of the Nth temperature.

12. The method according to claim 1, wherein cold pressurisation of the precursor is at ambient temperature.

13. The method according to claim 1, wherein the α+β Ti alloy is a Ti-6Al-4V alloy.

14. The method according to claim 1, wherein the Nth pressure is in a range from 90 MPa to 125 MPa and/or the Nth temperature is in a range from 875° C. to 925° C.

15. The method according to claim 1, wherein the article is an aerospace component, a vehicle component, or a medical component.

* * * * *